US010024148B2

(12) United States Patent
Ayasse

(10) Patent No.: US 10,024,148 B2
(45) Date of Patent: Jul. 17, 2018

(54) HYDROCARBON RECOVERY PROCESS EXPLOITING MULTIPLE INDUCED FRACTURES

(71) Applicant: IOR Canada Ltd., Calgary (CA)

(72) Inventor: Conrad Ayasse, Calgary (CA)

(73) Assignee: 1OR Canada Ltd., Calgary, Alberta ( * ) Notice: Subject to any disclaimer, the term of this patent is extended or adjusted under 35 U.S.C. 154(b) by 0 days.

(21) Appl. No.: 15/619,305

(22) Filed: Jun. 9, 2017

(65) Prior Publication Data

US 2017/0275978 A1 Sep. 28, 2017

Related U.S. Application Data

(62) Division of application No. 14/324,061, filed on Jul. 3, 2014, now abandoned.

(30) Foreign Application Priority Data

Jul. 4, 2013 (CA) ..... 2820742
Nov. 28, 2013 (CA) ..... 2835592

(51) Int. Cl.
*E21B 43/17* (2006.01)
*E21B 43/14* (2006.01)
*E21B 43/26* (2006.01)

(52) U.S. Cl.
CPC ..... *E21B 43/14* (2013.01); *E21B 43/17* (2013.01); *E21B 43/26* (2013.01)

(58) Field of Classification Search
CPC ..... E21B 43/26
See application file for complete search history.

(56) References Cited

U.S. PATENT DOCUMENTS 4,068,717 A 1/1978 Needham
4,687,059 A 8/1987 Pathak et al.
(Continued)

FOREIGN PATENT DOCUMENTS

GB 2512122 A 9/2014
WO WO 2012054139 * 8/2011 ..... E21B 43/26
(Continued)

*Primary Examiner* — William D Hutton, Jr.
*Assistant Examiner* — Avi T Skaist
(74) *Attorney, Agent, or Firm* — D. Doak Horne

(57) ABSTRACT

A method for enhancing production from multiple-fractured underground "tight" formations. Spaced upwardly-extending injection fissures are created along a horizontal injection wellbore, and upwardly-extending collection fissures, alternately spaced with the injection fissures, are created along the horizontal injection wellbore or another adjacent production wellbore. The injection wellbore is supplied with fluid under pressure, which flows into such created fissures and drives reservoir fluids within the formation to the remaining (alternately) spaced adjacent fissures along such wellbore or another parallel adjacent (production) wellbore, thereby allowing reservoir fluids to flow downwardly along such alternately spaced production fissures for collection. In a refinement, production is carried out initially from both the production and injection wellbores, and upon the rate of production of hydrocarbons slowing, production from the injection wellbore is stopped and a fluid is injected therein and thus into the formation via the alternate spaced fissures, thereby re-pressurizing the formation.

5 Claims, 15 Drawing Sheets

(56) References Cited

U.S. PATENT DOCUMENTS

| | | | | |
|---|---|---|---|---|
| 4,733,726 | A | 3/1988 | Alameddine et al. | |
| 6,298,916 | B1 | 10/2001 | Tibbles et al. | |
| 7,069,990 | B1 | 7/2006 | Bilak | |
| 7,441,603 | B2 | 10/2008 | Kaminsky et al. | |
| 8,122,953 | B2 | 2/2012 | Cavender et al. | |
| 2005/0072567 | A1 | 4/2005 | Steele et al. | |
| 2006/0118305 | A1 | 6/2006 | East, Jr. et al. | |
| 2006/0175061 | A1* | 8/2006 | Crichlow | E21B 43/2406 166/302 |
| 2006/0180306 | A1 | 8/2006 | Stone | |
| 2006/0289157 | A1 | 12/2006 | Rao | |
| 2008/0087425 | A1 | 4/2008 | Hsu et al. | |
| 2009/0038795 | A1* | 2/2009 | Kaminsky | E21B 43/2405 166/266 |
| 2012/0043081 | A1 | 2/2012 | Kjorholt Halvor | |
| 2012/0168182 | A1 | 7/2012 | Hsu et al. | |
| 2013/0043030 | A1 | 2/2013 | Snider | |
| 2013/0048279 | A1 | 2/2013 | Appel et al. | |
| 2015/0096756 | A1 | 4/2015 | Sharma et al. | |

FOREIGN PATENT DOCUMENTS

| | | | |
|---|---|---|---|
| WO | 2012054139 | A2 | 4/2012 |
| WO | 2013130491 | A2 | 9/2013 |

* cited by examiner

HYDROCARBON RECOVERY PROCESS EXPLOITING MULTIPLE INDUCED FRACTURES

CLAIM OF BENEFIT TO PRIOR APPLICATIONS

This application is a divisional to U.S. patent application Ser. No. 14/324,061 filed Jul. 3, 2014, which claims priority to Canadian Patent Application No. 2,820,742, filed Jul. 4, 2013, and to Canadian Patent Application No. 2,835,592 filed Nov. 28, 2013, each of which are hereby incorporated by reference in their entirety.

FIELD OF THE INVENTION

The present invention relates to a fluid-drive hydrocarbon recovery process, and more particularly to a fluid drive process which uses fluid injection in alternating fractures which have been mechanically induced in a subterranean hydrocarbon-containing formation, with oil and/or gas production from the alternating fractures.

BACKGROUND OF THE INVENTION AND DESCRIPTION OF THE PRIOR ART

Multiple fracturing of oil, gas and coal bed methane-bearing formations, where such formations have low permeability (i.e. "tight" reservoirs) are typically necessary to adequately produce hydrocarbons. Various of such methods are now fully commercialized in the prior art as primary oil and/or gas recovery methods.

Two types of completions for fracturing formations that are currently employed are Packers Plus Energy Services Inc.'s StackFrac™[1] process which uses open hole completions, and lined/cemented completions using technology (valves, liners, and the like) supplied by Halliburton Company. A horizontal hole is drilled low in the target consolidated tight-rock hydrocarbon reservoir. In the Halliburton technology, a liner is emplaced in the hole and cemented-in. This assures that there is no direct communication between the future induced fractures along the outside of the wellbore. In the Packers Plus technology, the fractures are accomplished from an open hole-there is no liner. Isolating packer seals ("packers") situated on injection tubing are actuated down-hole when in the well, so as to press against the rock itself in order to isolate the zones when conducting fracturing operations and create fissures in the rock, which typically extend upwardly from a horizontal wellbore. After the fracturing operation, the packers are deactivated and all fractures then produce to the surface, in a process termed "primary production" which terminology is adopted and used herein. Fractures are kept open by the deposit within the fractures of a "proppant" that has been carried into the fractures by the fracturing fluid. Proppants typically consist of sand, metallic or ceramic balls, and/or various chemicals, and provide a relatively high permeability flow channel. Formation fluids that flow into the fractures then easily drain to production tubing within the horizontal hole or wellbore for conveyance to the surface.

[1]StacFrac™ is a registered trademark of Packers Plus Energy Services Inc. for inter alia the wares of packers, frac-ports, and ball seats.

A major characteristic and benefit of multiple-induced fractured reservoirs is high initial production rates. Problematically, however, when producing from all fractures simultaneously the production rates for such reservoirs typically suffer rapid decline as pressure drops within the formation, for reasons as explained below. The multiple fracturing process is expensive, and the overall recovery factors for these types of formations are typically low, usually achieving recovery factors of less than 10% for oil. In order to maintain satisfactory field-wide production rates, a vigorous program of capital-intensive drilling of new multiple-fractured wells is required to compensate for the high decline rate. The oil production mechanism is by solution gas drive, and thus there is a rapid decline in the reservoir pressure which is detrimental to the potential future oil recovery. In this regard, as solution gas comes out of solution with declining pressure within the formation, the viscosity of the remaining oil increases because light components are removed from the oil.

Furthermore, two-phases of intermingled oil and gas are established, thereby decreasing the oil relative permeability and further reducing production rates. Consequently the oil flow rate decreases rapidly.

Because hydrocarbons such as shale gas and coal bed methane occur in formations of low permeability, recovery of these types of hydrocarbons particularly suffer from low recovery factors.

What is needed is a hydrocarbon recovery method for use in conjunction with multiple-fractured tight reservoirs, so as to reduce or limit the rapid decline in pressure in the formation which typically results, and to limit the number of needed multiply-fractured wells which are needed in "tight" formations to achieve satisfactory percentage recovery from such formations. In particular, an effective fluid-drive process for formations that have and need multiple-induced fractures, that can be applied as a primary as well as secondary oil recovery method, would be especially beneficial.

In addition to oil and gas reservoirs, a similar problem occurs in tight coal-bed methane formations. Methane is adsorbed on the coal, and is recovered by de-pressuring the formation, which provides only partial release of the methane from the coal surface. What is needed is an effective fluid drive process, ideally using $CO_2$, which adsorbs much more strongly than methane.

US 2013/0048279 as best seen from FIG. 3 thereof, teaches two parallel vertical wells, a second placed a distance from the first, wherein the mechanism to produce oil or gas from the formation is located at the second well.

US 20120168182 and US 20080087425 both teach inter alia a method for producing oil and/or gas comprising injecting a miscible enhanced oil recovery formulation into fractures of a formation for a first time period from a first well; producing oil and/or gas from the fractures, from a second well for the first time period; injecting a miscible enhanced oil recovery formulation into the fractures for a second time period from the second well; and producing oil and/or gas from the fractures from the first well for the second time period.

US 2006/0289157 teaches a process using gas-assisted gravity drainage, comprising placing one or more horizontal producer wells near the bottom of a pay zone of a subterranean hydrocarbon-bearing reservoir and injecting a fluid displacer such as $CO_2$ through one or more vertical wells or horizontal wells. Pre-existing vertical wells may be used to inject the fluid displacer into the reservoir. As the fluid displacer is injected into the top portion of the reservoir, it forms a gas zone, which displaces oil and water downward towards the horizontal producer well(s).

US 2006/0180306 teaches a method for recovering crude oil from subterranean reservoirs by injecting both water and a second less dense fluid to displace the oil, preferably through horizontal wells.

U.S. Pat. No. 8,122,953 teaches inter alia a method of improving production of fluid from a subterranean formation including the step of propagating a generally vertical inclusion into the formation, from a generally horizontal wellbore intersecting the formation.

U.S. Pat. No. 7,441,603 teaches a method for recovery of oil from impermeable oil sands, comprising providing vertical fractures using horizontal or vertical wells. The same or other wells are used to inject heated pressurized fluids and to return the cooled fluid for reheating and recycling. The heat transferred to the oil shale gradually matures the kerogen to oil and gas as the temperature in the shale is brought up, and also promotes permeability within the shale in the form of small fractures sufficient to allow the shale to flow into the well fractures U.S. Pat. No. 7,069,990 teaches a process for enhanced oil recovery, comprises providing at least one production well and one injection well; and injecting into the target stratum a slurry formed from sand, viscous liquids or oily sludge, which is delivered at or near formation fracture pressures. Monitoring of bottom hole pressure is carried out, to permit delivery of the slurried wastes in a series of injection episodes.

U.S. Pat. No. 4,733,726 teaches a method for recovery of oil, which provides injection of steam via an injection well into the formation and oil is recovered until there is steam breakthrough at the production well. Thereafter, the production well may be shut in or throttled while continuing injection of the steam until the bottom-hole injection pressure is greater than the vertical pressure created by the overburden thereby causing the formation to fracture horizontally. A third cycle is initiated in which oil is recovered from the formation from either the production well or the injection well or both until the amount of oil recovered is unfavorable.

U.S. Pat. No. 4,687,059 teaches injection of water into a subterranean formation followed by the injection of a polymer solution to drive oil toward a production well. The polymer solution may thermoelastically fracture the formation behind an oil-water bank to increase the injectivity rate.

U.S. Pat. No. 4,068,717 teaches a oil recovery process by injecting steam into an injection well penetrating the reservoir sufficiently to fracture the tar sand and provide passage for the steam through the tar sand to a production well piercing a tar sand reservoir.

None of the above prior art, however, teaches anything about creating, in alternating arrangement, injection fissures and producing fissures, to sweep a formation.

What is needed is a hydrocarbon recovery method for use in conjunction with multiple-fractured tight reservoirs, so as to reduce or limit the rapid decline in pressure in the formation which typically results, and to limit the number of needed multiply-fractured wells which are needed in "tight" formations to achieve satisfactory percentage recovery from such formations. In particular, an effective fluid-drive process for formations that have multiple-induced fractures, that can be applied as a primary as well as secondary oil recovery method, would be especially beneficial.

SUMMARY OF THE INVENTION

To improve both production rate and percentage recovery from "tight" formations, and in particular from multiple-fractured wells, in one embodiment the present invention provides for the creation of multiple-induced fractures in a hydrocarbon formation but in particular in two alternating groups, namely injection fractures and producing fractures, which are situated in linear alternating arrangement, when approximately ½ of the fractures are used as injection means and the remaining ½ of the fractures used a production means to recover hydrocarbons. Such method provides an efficient fluid drive to effectively sweep the formation and drive hydrocarbons into adjacent alternating fissures for subsequent collection. The present method in such embodiment improves recovery from a formation by providing a fluid drive via alternate adjacent fissures in the formation, with remaining alternately spaced fissures being used for production.

Specifically, with methods which employ primary oil recovery by solution gas drive (for example using a vertical injector well for injecting a gas into the formation but not using alternating fractures as injectors and collector channels as described above and below) and particularly with "tight" formations, as mentioned above typically results in rapid decline in pressure of the formation, causing a corresponding rapid decline in production.

Conversely, with the method of the present invention, a high-pressure and high permeability injection plane [i.e. the alternatingly spaced fissures located adjacent alternatingly spaced production channels (fissures)] is provided, which then allows a sweep of areas of the reservoir proximate the high permeability injection planes to thereby cause a fluid flow vectors within the formation from the high permeability injection plane in the direction of the alternatingly-spaced production channels (fissures), and consequent improved sweep of the formation through directed sweep process.

The methods herein are adapted for use in oil and gas containing reservoirs, and are also particularly suited for a particular type of gas-bearing formation, namely coal-bed methane formations, where the driving fluid in the method of the present invention using alternating injection and recovery channels is $CO_2$, and which $CO_2$ driving fluid advantageously replaces methane on the coal surface and sweeps it to a proximate adjacent production well. Advantageously, where $CO_2$ is used as a driving fluid in accordance with the method of the present invention, such method advantageously provides for carbon sequestration in the form of subterranean sequestration of the $CO_2$.

Specifically, in a further aspect of the invention, a well completion method is provided in which a plurality of expandable packers are used.

In a first embodiment, vertical fractures are established from a horizontally-drilled open hole or from a cemented liner therein. Thereafter, a dual tubing (in the form of continuous tubing or segmented pipe) with spaced-apart isolation packers is run into the open hole or cemented liner. The spaced-apart packers on the tubing are located between the fractures. Once the packers are expanded against the hole or liner, the fractures will be isolated from each other within the hole or liner. One of the tubings has perforations opposite alternating fractures, and the other tubing has perforations opposite the remaining fractures. In this way, one tubing string can be employed as an injection tubing in fluid communication with the alternating injection fractures, and the other as a production tubing in fluid communication with the remaining (alternating) producing fractures.

Accordingly, in said first embodiment of the method of the present invention for recovering hydrocarbons from a subterranean formation using fluid injection in alternating fissures in said formation, using dual tubing packers, such method comprises the steps of:

(i) drilling a single injection/production well in said formation, having a vertical portion and a lower horizontal portion extending horizontally outwardly from a lower end of said vertical portion;

(ii) fracturing the formation along said horizontal portion of said injection/production well and creating a plurality of upwardly-extending fissures extending upwardly from, and situated along a length of, said horizontal portion;

(iii) placing a plurality of packers each having dual tubing therein along said length of said horizontal portion of said injection/production well and alternatingly spacing said packers between said upwardly-extending fissures along said length thereby partitioning said length into alternatingly-spaced fluid injection regions and fluid recovery regions, one of said dual tubing having perforations therein opposite alternatingly-spaced fissures and the other of said dual tubing having perforations therein opposite remaining alternatingly-spaced fissures;

(iv) injecting a pressurized fluid into one of said dual tubing and thereby injecting pressurized fluid into said fluid injection regions and thus into alternatingly-spaced fissures along said length of said horizontal portion of said injection/production well; and (v) producing said hydrocarbons which drain into said alternatingly-spaced fluid recovery regions via other alternatingly-spaced fissures from said other of said dual tubing.

The fissures may be created prior to inserting the dual-tubing packers in the wellbore. Alternatively, they may be created after inserting dual-tubing packers into the horizontal portion of the injection/production well, and pressurized fluid initially supplied to both of the dual tubings to thereby hydraulically fracture the formation and create uniformly spaced fissures along the wellbore. Thereafter, pressurized fluid is only supplied to ½ of the created fissures (i.e. to every other fissure along the length of the horizontal portion of the wellbore), and remaining alternately spaced fissures allow hydrocarbons to drain downwardly into a corresponding fluid recovery region of the injection/production well, and thereafter be produced to surface by the other of the dual tubing.

One example of dual-tubing packers which may be suitable for use in this embodiment process of the present invention, at least in a cased wellbore, are dual-tubing packers, namely GT™[2] Dual-String Retrievable Packer, Product Family Nos. H78509 (Standard Service) and H78510 (NACE Service) manufactured by Baker Hughes Corporation, for use in 7 inch (177.8 mm) o.d. (outside diameter) casing, 7⅝ inch (193.7 mm) o.d. casing, or 9⅝ inch (244.5 mm) o.d. casing. Other suitable dual-tubing packers for use in this process, both in cased and uncased wellbores, will now occur to persons of skill in the art.

[2]GT is a trademark of Baker Hughes Corporation for a dual-tubing packer.

In a most preferred embodiment, a chosen fluid (a gas or liquid) is injected through the injection tubing. The fluid rises in the formation via each alternate injection fissures which generally extend vertically upwardly from horizontal wells. Such injected fluid then sweeps the reservoir fluid laterally in the formation towards the adjacent producing fissures on each side, whence drainage will be established down into the production tubing for subsequent production of such formation fluids to surface.

In an alternate embodiment of the invention (the "first variation"), instead of utilizing a dual-tubing within a single wellbore which dual tubing comprises respectively the injection tubing and the production tubing, such embodiment provides for use of two (2) separately-drilled horizontal wells, namely an injection well and a production well, each parallel to the other and in close proximity to the other, wherein one of such horizontal wells is used for supplying a pressurized fluid to upwardly-extending fissures which have been created along a horizontal length of a such injection well, and the other well is used as the production well for fractures that have been created along such remaining horizontal well that are alternately spaced and are interdigitated between alternate fissures created along the injection well. Specifically, upwardly extending substantially vertical injection fractures/fissures are established along the horizontal portion of the injection well. Vertical fractures/fissures are also likewise established along the horizontal portion of the production well, but these fractures are laterally offset from the fractures established form the injection well. In other words, scanning horizontally across the formation, the intercepted fractures are alternatively fluid-injection fractures and producing fractures. Production occurs by a fluid being injected via the injection well into fissures along such horizontal (injection) well, and reservoir fluids are then driven into alternately spaced fissures previously created along the horizontal production well, which reservoir fluids then flow downwardly and are collected in production tubing within the production well. Advantageously in such manner the injected fluid is injected in the formation where it may most easily and directly carry out its intended purpose, namely to best direct reservoir fluids into alternately spaced adjacent fissures within the formation, which thereby drain downwardly. Such reservoir fluids, after draining downwardly in said alternately-spaced fissures, are recovered by the production tubing in the production well and produced to surface.

The lateral separation distance between various adjacent sequential injection and production fractures/fissures may vary, or may be constant, and will be selected based on standard reservoir engineering analysis of the properties of the formation obtained through various known and widely used well logging techniques, and will depend on reservoir parameters along the wells, such as but not limited to, matrix permeability, matrix fracture pressure, produced hydrocarbon mobility, injectivity of the injection fluid, and desired injection and production rates. Numerical simulation using software such as licensed by the Computer Modelling Group of Calgary, Alberta, Canada can assist in the selection of injection fluid and determination of lateral offset of the individual injection and production fractures relative to each other.

Accordingly, in a broad alternate aspect, the process of the present invention comprises a process for recovering hydrocarbon from a subterranean formation utilizing propped hydraulic fractures, comprising the steps of:

(i) drilling an injection well having a vertical portion and a horizontal portion extending horizontally outwardly from a lower end of said vertical portion thereof;

(ii) drilling a production well having a vertical portion and a horizontal portion extending outwardly from a lower end of said vertical portion thereof, wherein said horizontal portion of said production well is situated parallel to said horizontal portion of said injection well;

(iii) creating upwardly-extending fissures in the formation along each of said horizontal portions of said production well and injection well by injecting a pressurized fluid into each of said production well and injection well, at a plurality of discrete locations along a length of each of said horizontal portion of each of said production well and injection well, wherein said discrete locations in said production well substantially correspond in number to said discrete locations in said injection well and wherein said discrete locations and each of said respective fissures extending upwardly along said injection well are in alternating linear spacing and substantially mutually adjacent relation with corresponding respective fissures extending upwardly along said horizontal portion of said production well;

(iv) said pressurized fluid containing a proppant, or alternatively after step (ii) above injecting a proppant under pressure into said created fissures to render said fissures in a propped condition; and (v) continuing to inject said pressurized fluid, or injecting another fluid, into said injection well and thereby into said fissures above said injection well and thence into said formation thereby pressurizing said formation and causing said hydrocarbons within said formation to be driven into said fissures above said production well, and to drain downwardly therein into said horizontal portion of said production well; and (vi) producing said hydrocarbons which collect in said horizontal portion of said production well to surface.

In a similar embodiment of the invention, the invention comprises a process for recovering hydrocarbons from a subterranean formation utilizing propped hydraulic fractures comprising the steps of:

(i) drilling an injection well, having a vertical portion and a horizontal portion extending horizontally outwardly from a lower end of said vertical portion along a lower portion of the formation;

(ii) drilling a production well having a vertical portion and a horizontal portion extending outwardly from a lower end of said vertical portion, wherein said horizontal portion of said production well is situated proximate to, parallel with, and spaced apart from, said horizontal portion of said injection well;

(iii) fracturing the formation along each of said production well and injection well and creating a plurality of upwardly-extending fissures extending upwardly from, and situated along a length of, said horizontal portion of each of said injection well and said production well, said upwardly-extending fissures created along said injection well mutually alternating along said horizontal length thereof with upwardly-extending fractures situated along said production well;

(iv) utilizing injection tubing, having therealong a plurality of spaced-apart packer seals within a length of said horizontal portion of said injection well, said injection tubing further having apertures or apertures which may be opened intermediate pairs of said spaced-apart packer seals situated at locations at which said upwardly-extending fractures are located along said injection well, and injecting a pressurized fluid into said injection tubing and into said fissures extending along said horizontal portion of said injection well;

(v) utilizing production tubing , having therealong a plurality of spaced-apart packer seals similarly spaced apart as per said packer seals along said injection tubing, said production tubing further having apertures, or apertures which may be opened, intermediate pairs of said spaced-apart packer seals, along a length of said horizontal portion of said production well, wherein said apertures in said production tubing are positioned in alternating and non-lateral alignment with said apertures located in said injection tubing, and collecting from said formation hydrocarbons in said production tubing which flow into said fissures and which drain downwardly into said production tubing via said apertures therein; and (vi) producing the hydrocarbons which collect in said production tubing to surface.

The above method may be used wherein the injection well is an open hole, or one where a liner is used. Where a liner is used, packer seals need not be used, but the hole must be lined and cemented , otherwise the first wellbore will fill with injection fluid when the second wellbore is fractured. Specifically, where a lined well(s) are desired and no packer seals are therefore needed, the above method is further modified, wherein:

(a) step (i) above further comprises the step of inserting and cementing a liner in the injection well;

(b) step (ii) further comprises the step of inserting and cementing a liner in said production well;

(c) adding a step, after step (ii), of creating perforations in said liner and cement in each of said horizontal portions of said production and injection wells, at a plurality of discrete allocations therealong, wherein said discrete locations in said production well are approximately equal in number but linearly alternating with said corresponding perforations created in said cemented liner in said injection well.

Alternatively to the above methods, a two-step process may be undertaken. Specifically, after creating the fractures along each of the production well and injection wells in the manner described above, both the production well and injection wells are initially put on production as is traditionally done, producing reservoir fluids which drain downwardly from all fissures (primary production). Thereafter, namely at a point in time when production rates typically drop off and start to become uneconomical as typically occurs in multiple-fractured "tight" formations, production from the injection well is stopped, and a fluid is then injected into alternate fissures via tubing within the injection well, to thereby begin the fluid drive process described above, with fluid production continuing from remaining alternately spaced fissures in the formation. In such manner the production rate can be restored to similar earlier levels, and the overall recovery from the formation increased.

Accordingly, in accordance with the above two-step process, in one embodiment thereof such process comprises a process for recovering hydrocarbons from a subterranean formation utilizing propped hydraulic fractures comprising the steps of:

(i) drilling an injection well, having a vertical portion and a horizontal portion extending horizontally outwardly from a lower end of said vertical portion;

(ii) inserting tubing, having therealong a plurality of spaced-apart packer seals, within a length of said horizontal portion of said injection well, said tubing further having apertures or apertures which may be opened intermediate pairs of said spaced-apart packer seals;

(iii) drilling a production well proximate said injection well, having a vertical portion and a horizontal portion extending outwardly from a lower end of said vertical portion, wherein said horizontal portion of said production well is situated proximate to, parallel with, and spaced apart from, said horizontal portion of said injection well;

(iv) inserting tubing , having therealong a plurality of spaced-apart packer seals similarly spaced apart as per said packer seals in said injection well, said tubing further having apertures, or apertures which may be opened, at locations intermediate pairs of said spaced-apart packer seals, along a length of said horizontal portion of said production well, wherein said apertures in said tubing in said production well are positioned in non-lateral alignment with said apertures in said injection well;

(v) setting, if necessary, said packer seals in each of said respective horizontal portions of said injection well and said production well so as to prevent flow of fluid along an annular passage intermediate said tubing and said production well and injection well, respectively;

(vi) injecting into said injection well, a fluid under pressure and causing said fluid to flow into said formation via said apertures in said tubing therein, so as to create upwardly extending fissures at each of said apertures along said injection well;

(vi) injecting into said production well, a fluid under pressure and causing said fluid to flow into said formation via said apertures in said tubing therein , so as to create upwardly extending fissures at each of said apertures along said production well;

(vii) after step (vi) collecting , via said tubing in said horizontal portion of said production well and said horizontal portion of said injection well, said hydrocarbons which flow into said fissures and which drain downwardly into said tubing in said production well and said injection well;

(ix) after a period of time and when production from said production well and said injection well decreases to an unsatisfactory rate, injecting a fluid into said injection well and into said upwardly-extending fissures along said injection well; and (x) continuing to collect , via said horizontal portion of said production well, said hydrocarbons which flow into said fissures above said production well and which drains downwardly into said tubing in said production well .

In a variation of the present invention (the "second variation"), only a single (injection/production) well is drilled, and pairs of adjacent fissures are used as an injection fissure and an adjacent production fissure, respectively , with fluid in the injection fissure forcing hydrocarbons in the formation to the production fissure. Thereafter, either the production fissure is converted into an injection fissure by injection of fluids therein, or the injection fissure is converted into a production fissure, and a "sweeping" method is used as set out below.

Specifically, in a first embodiment of such second variation, after production for a time from a production fissure, production of hydrocarbons from said production fissure is ceased, and such fissure subsequently used, in the manner described below, as an injection fissure, and fluids injected therein drive hydrocarbons to another (other) adjacent production fissure(s).

Accordingly, in such first embodiment of this second variation, such method comprises a process for recovering hydrocarbons from a subterranean formation utilizing propped hydraulic fractures comprising the steps of:

(i) drilling an injection/production well, having a vertical portion and a horizontal portion extending horizontally outwardly from a lower end of said vertical portion, said horizontal portion having a heel portion proximate said vertical portion, and a toe portion proximate a distal end of said horizontal portion;

(ii) creating upwardly-extending fissures in the formation along said horizontal portion by injecting a pressurized fluid at a plurality of discrete spaced locations along a length of said horizontal portion ;

(iv) said pressurized fluid containing a proppant, or alternatively after step (ii) above injecting a proppant under pressure into said created fissures to render said fissures in a propped condition; and (v) positioning injection tubing into said wellbore, said injection tubing having an actuatable packer member proximate a distal end of said tubing adapted when actuated to create a seal between said tubing and said wellbore, and situating such packer member and injection tubing within said wellbore on a heel side of a most distal upwardly-extending fissure;

(vi) injecting said pressurized fluid, or injecting another fluid, into said injection tubing so as to cause said fluid to flow into said most distal upwardly-extending fracture, and producing oil to surface which flows into an annular area in said wellbore via a penultimate fissure adjacent said most distal upwardly-extending fissure;

(vii) deactivating said packer member and moving said packer member and injection tubing toward said vertical portion, and re-instituting injection of said fluid so as to inject said fluid into said penultimate upwardly-extending fissure, and producing oil which flows into said annular area via a fissure adjacent said penultimate fissure on a heel side of said penultimate fissure.

Of course, rather than commencing at the toe portion and initially injecting fluid into the most distal upwardly extending fracture, commencing at the heel, such method may be similarly employed by instead initially injecting through the most proximal upwardly-extending fissure which is proximate the heel, and thereafter progressing in the manner described above toward the toe.

Accordingly, in such alternate process, such comprises the steps of:

(i) drilling an injection/production well, having a vertical portion and a horizontal portion extending horizontally outwardly from a lower end of said vertical portion, said horizontal portion having a heel portion proximate said vertical portion, and a toe portion proximate a distal end of said horizontal portion ;

(ii) creating upwardly-extending fissures in the formation along said horizontal portion by injecting a pressurized fluid at a plurality of discrete spaced locations along a length of said horizontal portion ;

(iv) said pressurized fluid containing a proppant, or alternatively after step (ii) above injecting a proppant under pressure into said created fissures to render said fissures in a propped condition; and (v) positioning injection tubing into said wellbore , said injection tubing having an actuatable packer member proximate a distal end of said tubing adapted when actuated to create a seal between said tubing and said wellbore, and situating said packer member and injection tubing within said wellbore on a toe side of a most proximal upwardly-extending fissure;

(vi) actuating said packer member and injecting said pressurized fluid, or injecting another fluid, into said injection tubing so as to cause said fluid to flow into one or more of remaining upwardly-extending fissures, and producing oil to surface which flows into an annular area in said wellbore via said most proximal fissure;

(vii) de-actuating said packer member and moving said packer member and injection tubing toward said toe portion, re-activating said packer member and re-instituting injection of said fluid, and injecting said fluid into remaining upwardly-extending fissures, and producing oil which flows into said annular area via said most proximal fissure and a further adjacent penultimate fissure.

In a second embodiment of the above second variation, after injection of fluid for a time into an injection fissure has occurred, injection of fluids into said injection fissure is ceased, and such fissure subsequently used, in the manner described below, as a production fissure which has hydrocarbons driven to such converted fissure via fluid injected into the formation via another (other) injection fissures.

Accordingly, in such second embodiment of this second variation, such method comprises a process for recovering hydrocarbons from a subterranean formation utilizing propped hydraulic fractures which are employed as production channels and subsequently as injection channels, comprising the steps of:

(i) drilling an injection/production well, having a vertical portion and a horizontal portion extending horizontally outwardly from a lower end of said vertical portion, said horizontal portion having a heel portion proximate said vertical portion, and a toe portion proximate a distal end thereof;

(ii) creating upwardly-extending fissures in the formation along said horizontal portion by injecting a pressurized fluid at a plurality of discrete spaced locations along a length of said horizontal portion;

(iv) said pressurized fluid containing a proppant, or alternatively after step (ii) above injecting a proppant under pressure into said created fissures to render said fissures in a propped condition; and (v) positioning production tubing into said wellbore, said production tubing having an opening and an actuatable packer member thereon proximate a distal end thereof adapted when actuated to create a seal between said tubing and said wellbore, and situating said packer member proximate a toe region of said wellbore on a heel side of a most distal upwardly-extending fissure;

(vi) actuating said packer member and injecting said pressurized fluid, or injecting another fluid, into an annular area intermediate said production tubing and said wellbore and thereby injecting said fluid into a penultimate fissure adjacent said most distal upwardly-extending fracture, and producing hydrocarbons via said production tubing which drain into said wellbore via said most distal upwardly-extending fissure and which thereafter flow into said production tubing via said opening therein;

(vii) deactuating said packer member and moving said packer member and production tubing toward said heel portion, re-actuating said packer member and re-instituting injection of said fluid into said annular area so as to inject said fluid into an upwardly-extending adjacent fissure on a heel side of said penultimate fissure, and producing oil which flows into said production tubing via said penultimate fissure.

Again, rather than commencing at the toe portion and initially producing from the most distal upwardly extending fracture, such method may be modified to commence at the heel, such method may be similarly employed by instead initially injecting through the most proximal upwardly-extending fissure which is proximate the heel, and thereafter progressing in the manner described above toward the toe.

In such aspect of the second variation, such method comprises the steps of:

(i) drilling an injection/production well, having a vertical portion and a horizontal portion extending horizontally outwardly from a lower end of said vertical portion, said horizontal portion having a heel portion proximate said vertical portion, and a toe portion proximate a distal end thereof;

(ii) creating upwardly-extending fissures in the formation along said horizontal portion by injecting a pressurized fluid at a plurality of discrete spaced locations along a length of said horizontal portion;

(iv) said pressurized fluid containing a proppant, or alternatively after step (ii) above injecting a proppant under pressure into said created fissures to render said fissures in a propped condition; and (v) positioning production tubing in said wellbore , said production tubing having an opening and an actuatable packer member thereon proximate a distal end thereof adapted when actuated to create a seal between said tubing and said wellbore, and situating said packer member proximate a heel portion of said wellbore on a toe side of a most proximal upwardly-extending fissure ;

(vi) actuating said packer member and injecting said pressurized fluid, or injecting another fluid, into an annular area intermediate said production tubing and said wellbore and thereby injecting said fluid into said most proximal fissure adjacent, and producing hydrocarbons via said production tubing which drain into said wellbore via said remaining upwardly-extending fissure and which thereafter flow into said production tubing via said opening therein;

(vii) deactuating said packer member and moving said packer member and production tubing toward said toe portion, re-actuating said packer member and re-instituting injection of said fluid into said annular area so as to inject said fluid into a penultimate upwardly-extending fissure on a heel side of said most proximal fissure, and producing oil which flows into said production tubing via an adjacent remaining fissure.

In all embodiments of the method of the present invention the hydrocarbon recovered is preferably oil or gas.

In a refinement of the above methods, the recovered hydrocarbon is methane, and the injected fluid is $CO_2$.

In a further refinement, the injected fluid is miscible or immiscible in the hydrocarbon contained within the formation which is being recovered.

In a still further embodiment, the injected fluid is a gas, such as $CO_2$ or water vapour, or alternatively is a liquid such as water.

In a further embodiment, the injected fluid contains oxygen, for use in an in-situ combustion process.

DETAILED DESCRIPTION OF SOME PREFERRED EMBODIMENTS

Figure 1:
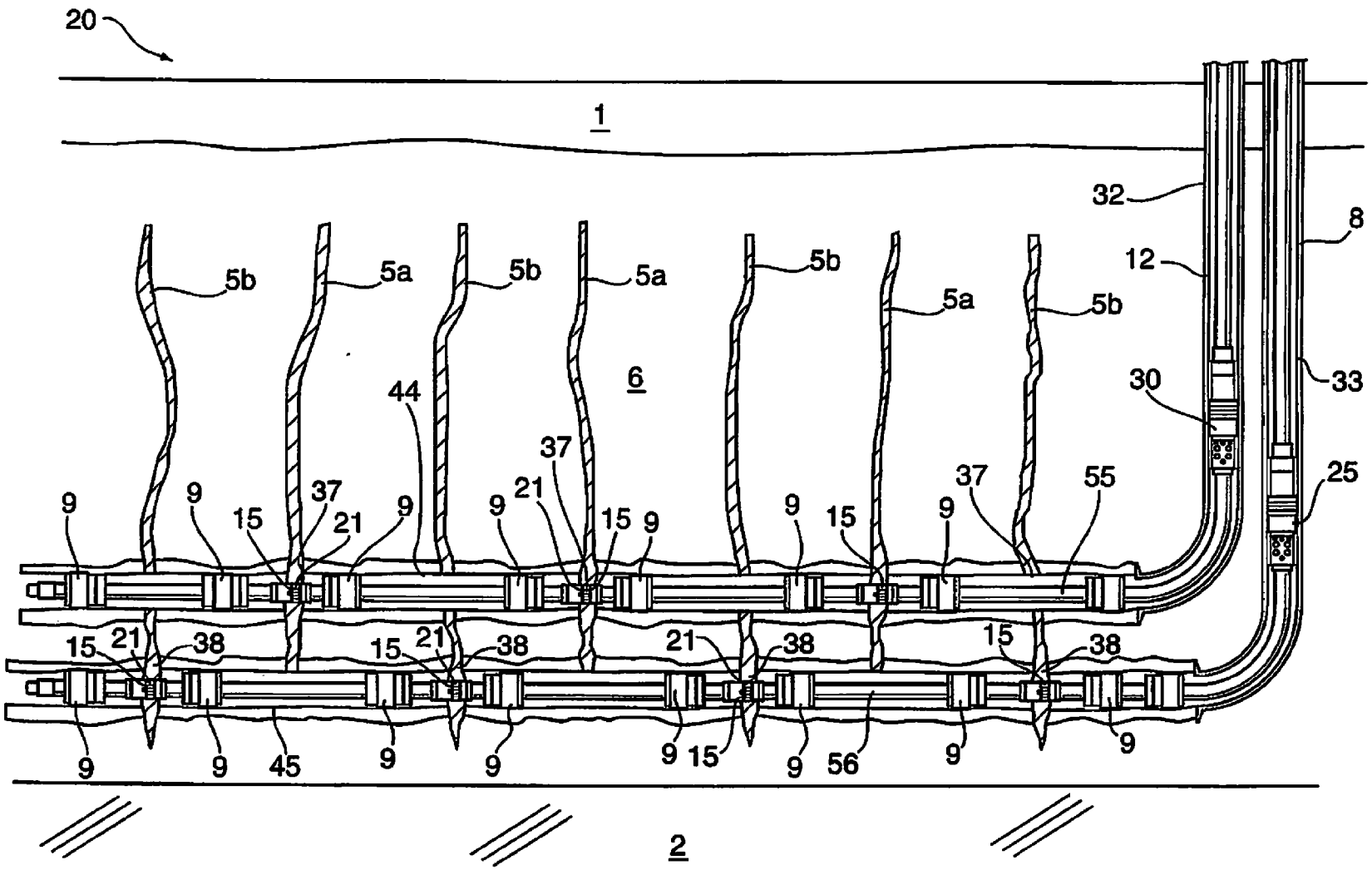
FIG. 1 is a side cross-sectional view of one embodiment (the "first variation") of the process of the present invention for fracturing and extracting oil from an underground formation, showing fluid flow through each of the two sets of fissures, namely alternately spaced injection fissures and production fissures.
Figures 2, 3:
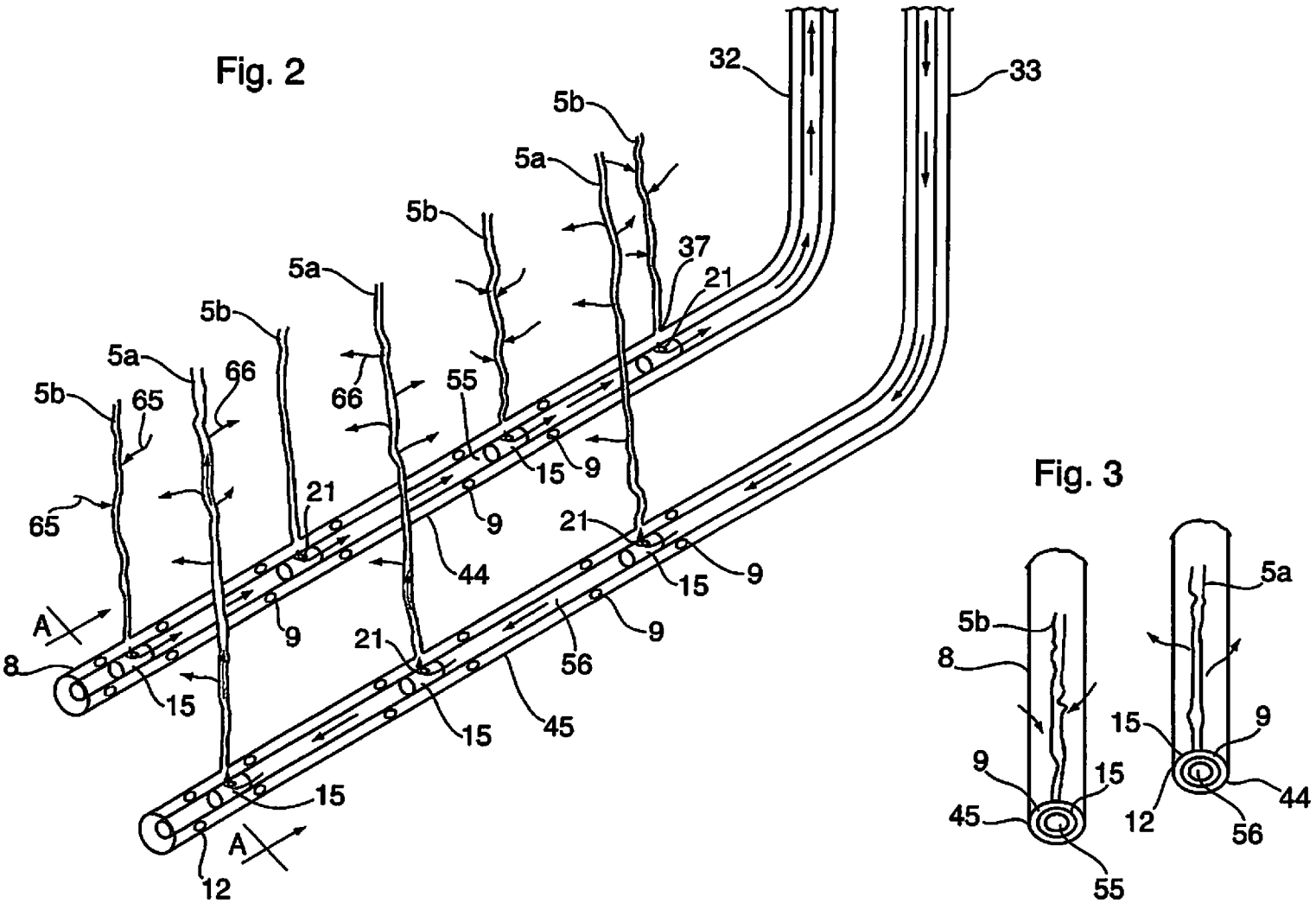
FIG. 2 is a perspective view of the embodiment of the invention shown in FIG. 1.
FIG. 3 is a partial cross-sectional view along arrows "A-A" of FIG. 2.

With reference to FIGS. 1, 2, & 3, item 20 indicates a depiction of one method ("the first variation") of the present invention for recovering hydrocarbons from a multiple-fractured a "tight" subterranean formation 6 possessing a hydrocarbon-containing reservoir, above which is typically a layer of cap rock 1 and below which is typically a layer of bottom rock 2.

Thus in such first variation two wells are drilled into reservoir 6, namely an injection well 12 having a vertical portion 32 and a horizontal portion 44, and a production well 8 similarly having a corresponding vertical portion 33 and a horizontal portion 45.

The horizontal portion 45 of the production well 8 is drilled parallel to, and proximate, the horizontal portion 44 of injection well 12, as shown in FIGS. 1 & 2. Horizontal portion 45 may be drilled level with, or alternatively spaced vertically above or below (see FIG. 3, for example) horizontal portion 44.

A liner (not shown) may be inserted into one or both of such wells 8, 12, and cemented in place. If a liner is used in production well 8 and injection well 12, the horizontal portion 45 of production well 8 is perforated at discrete locations 38 therealong using procedures well known to persons of skill in the art, and the horizontal portion 44 of injection well 12 is similarly perforated at (mutually alternating) discrete locations 37, to allow flow of pressurized fluid into the formation 6, and collection of hydrocarbons from the formation 6, as more fully explained below.

Fracturing of the formation 6 is conducted by injecting pressurized fluid at discrete locations 37, 38 along the length respectively of horizontal portions 44, 45 so as to create fissures 5*a*, 5*b* within formation 6 extending respectively upwardly from such discrete locations 37, 38 along horizontal portions 44, 45 respectively.

Importantly, discrete locations 37 along length of horizontal portion 44 of injection well 12 are in mutually alternating spaced relationship to those discrete locations 38 extending linearly along the length of the horizontal portion 45 of production wellbore 8, so as to thereby allow, when pressurized fluid in injected at such discrete locations 37,38, respectively upwardly-extending fissures 5*b*, 5*a* to be created in formation 6, in mutually alternating substantially linear relationship, as shown in FIGS. 1 & 2.

Figure 6:
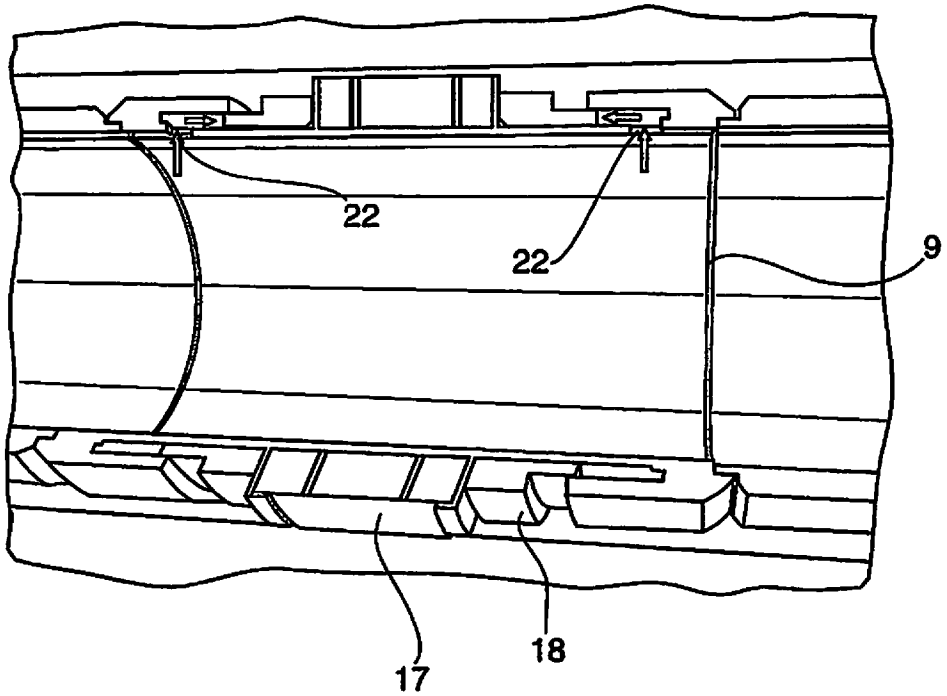
FIG. 6 is a sectional schematic view of a typical packer element which is used as part of the present process to, upon actuation after being inserted in a production well or injection well, create a seal to thereby isolate individual locations along the respective production well and injection well, to allow fracturing of the formation at discrete intervals along horizontal portions of the injection and production wells.

The fracturing may be conducted by inserting tubing 55, 56 in each of respective horizontal portions 44, 45, wherein each of tubing lines 55, 56 (which may be continuous tubing or jointed pipe string) possess a number of spaced-apart packer seals 9 along the length thereof. Packer seals 9, one example of which is depicted in FIG. 6, are well known in the art, and are commercially available from various well-known down-hole tool companies such as Packers Plus Inc. (particularly for un-lined wellbores) and by Halliburton company (particularly for lined and cemented wellbores). Packer seals 9, in one embodiment thereof as shown in FIG. 6, possess a hydraulically-actuated piston 18. When pressurized fluid is supplied to tubing lines 55, 56 to which such packer seals 9 are operatively coupled, such pressurized oil flows through ports 22 where it acts on dual pistons 18 which then laterally compress and causes radial expansion outwardly of a resilient material 17 (see FIG. 6), which resilient material 17 then creates a seal between horizontal wellbore 44, 45 (or tubing liner, as the case may be) and tubing 55, 56 respectively.

With reference to FIGS. 1-3, tubing 55, 56 may be hung , respectively, in vertical portions 32, 33 of injection and production wells 12, 8 by tubing hangers 30, 25, respectively, as shown in FIG. 1.

Figure 7:
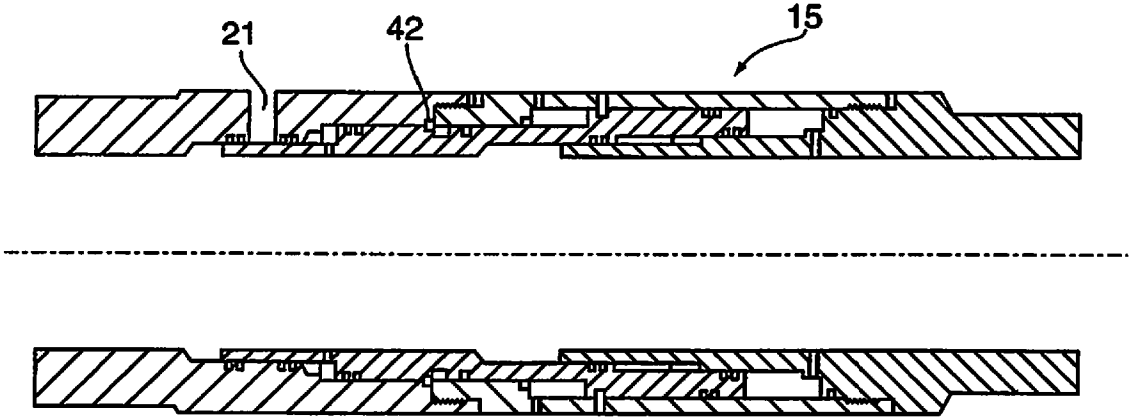
FIG. 7 is a cross-sectional view of a typical pressure-actuated sliding sleeve which is used as part of the present process, particularly in open hole configurations, wherein the sliding sleeve is shown in the closed position for insertion into an open hole, and may thereafter through hydraulic fluid pressure applied thereto, cause an aperture therein to open.

When elongate tubing 55, 56 is used, hydraulically-actuated sleeves 15 may be interposed intermediate pairs of packer seals 9. Such sleeves 15, one example of which is shown in detailed view in FIG. 7 (closed position) and FIG. 8 (open position), each possess an aperture 21, which upon application of hydraulic pressure to interior of sleeve 15 and release of locking ring 42, causes such aperture 21 to be opened to allow egress of pressurized fluid from within tubing 55, 56 to flow into the formation 6 so as to cause fracturing and thus create fissures 5*a*, 5*b*. Such sleeves 15 may, along with tubing 55, 56, be inserted, when in a closed position as shown in FIG. 7, down into respective horizontal portions 44,45, and when in a desired location 37, 38, be actuated via hydraulic pressure to cause sleeves 15 to expose apertures 21 (see FIG. 8), thereby allowing such pressurized hydraulic fluid to be exposed to the formation, thereby creating fissures 5*a*, 5*b*. Hydraulically actuated sleeves 15 are likewise commercially available, one such sleeve being available from Packers Plus Inc. of Calgary, Alberta.

Alternatively, creation of fissures 5*a*, 5*b* along horizontal portions 44, 45 respectively may be conducted by the traditional, if not somewhat outdated and more time consuming procedure of the so-called "plug and perf" procedure. In such procedure, a single pair of pressure-actuated packer seals 9 are provided at a distal end of tubing, such tubing having a single aperture 21 intermediate said pair of packer seals 9. The pair of packer seals 9 are actuated and thereby deployed to create a seal at various discrete locations 37,38 along each of horizontal portions 44, 45 by pushing (or pulling) such packer seals 9 and tubing along the length of each of said horizontal portions 44, 45, and at such time pausing to supply hydraulic fluid at each of the discrete locations 37,38 so as to create fissures 5*a*, 5*b* at each of such locations 37, 38 respectively therealong. Again, the discrete locations 37 in horizontal portion 44 of injection well 12 are in mutually alternating spaced arrangement to the discrete locations 38 in horizontal portion 45 of production well 8 in accordance with the method of the present invention, to thereby provide for the injection of pressurized fluid intermediate and closely proximate, adjacent fissures 5*b* as shown in FIGS. 1 & 2, so as to best be able to re-pressurize such "tight" formation 6 at locations where such repressurization is most useful.

Fluid which is injected for the purpose of creating fractures/fissures 5*a*, 5*b* as described above may contain a proppant to maintain the fissures 5*a*, 5*b* in an expanded position. Alternatively, after creation of such fissures 5*a*, 5*b*, a second fluid containing such proppant may thereafter be injected down-hole via tubing 55, 56 to maintain the created fissures in an "open" position.

The same fluid, or even a third fluid, may be used as the driving fluid when carrying out the method of the present invention for sweeping the formation .

Upon creating of fissures 5*a*, 5*b* in formation 6 , should no tubing such as tubing 55, 56 with associated packer seals 9 and sliding sleeves 15 have been previously used in fracturing and remain in place in horizontal portions 44, 45, such a tubing string 55, 56, and associated packer seals 9 and associated sleeves 15 are inserted in each of horizontal portions 44, 45. Packer seals 9 are then actuated, and adjacent fissures 5*a*, 5*b* thereby isolated from each other. An injection fluid is injected through the injection tubing 55. The injectant fills the vertical fractures Sa that are above the injection tubing 55, by travelling into fissures 5*a* via perforations in the well liner (if a well liner is used) at discrete locations 37 along horizontal portion 44, and rise in fissures Sa whereafter such injectant fluid is forced into the formation 6 and flows laterally towards the adjacent fissures 5*b* that are themselves in communication with the production tubing 56. Reservoir fluids that drain into the production tubing 56 are lifted to the surface, typically by pumping. The injectant fluid may be, but is not limited to, the following substances, namely: produced gas, flue gas and others; oxygen-containing gases such as air, oxygen or mixtures thereof in an in situ combustion process; liquids that may or may not be soluble in the reservoir hydrocarbon, such as water, steam or natural gas liquids.

In a preferred embodiment, this process of enhanced hydrocarbon recovery using hydraulically-induced and propped reservoir fractures 5*a* 5*b* is conducted in the native reservoir without de-pressuring in order to maintain the maximum hydrocarbon mobility. However, there will be occasions when the well operator will desire to conduct traditional primary petroleum production first, or where the reservoir has already been de-pressured, but nevertheless the present invention can still be utilized beneficially.

Due to the increased pressure in the formation 6 resulting from injection of fluid into the formation via fissures 5*b*, hydrocarbons and reservoir fluid present in formation 6 are encouraged and driven toward fissures 5*a* interposed between fissures 5*b*, as shown in FIGS. 2 & 3, and thereafter drain downwardly to be collected by production tubing 56, and thereafter are pumped to surface.

In a refinement of the above method, immediately upon creation of the fissures 5*a*, 5*b* along each of horizontal portions 44, 45 respectively, no injection of fluid is commenced in the injection well 12, and instead all fissures 5*a*, 5*b* are allowed to receive hydrocarbon fluids from the formation 6. Both the injection well 12 and the production well 8 used to collect and produce hydrocarbons to surface. After a period of time wherein ambient pressure in formation 6 has become reduced due to withdrawal of hydrocarbons from formation 6, and production thereof reduced to an unacceptably low production rate, injection well 12 is converted from a production well to an injection well, by pressurizing fluid being injected into horizontal portion 44 and thus into fissures 5*a*. Such procedure then creates zones of higher pressure substantially intermediate fissures 5*b*, thus "driving" remaining hydrocarbons in formation 6 into fissures 5*b*, for subsequent collection by production tubing 56, and for production to surface.

Figure 4A:
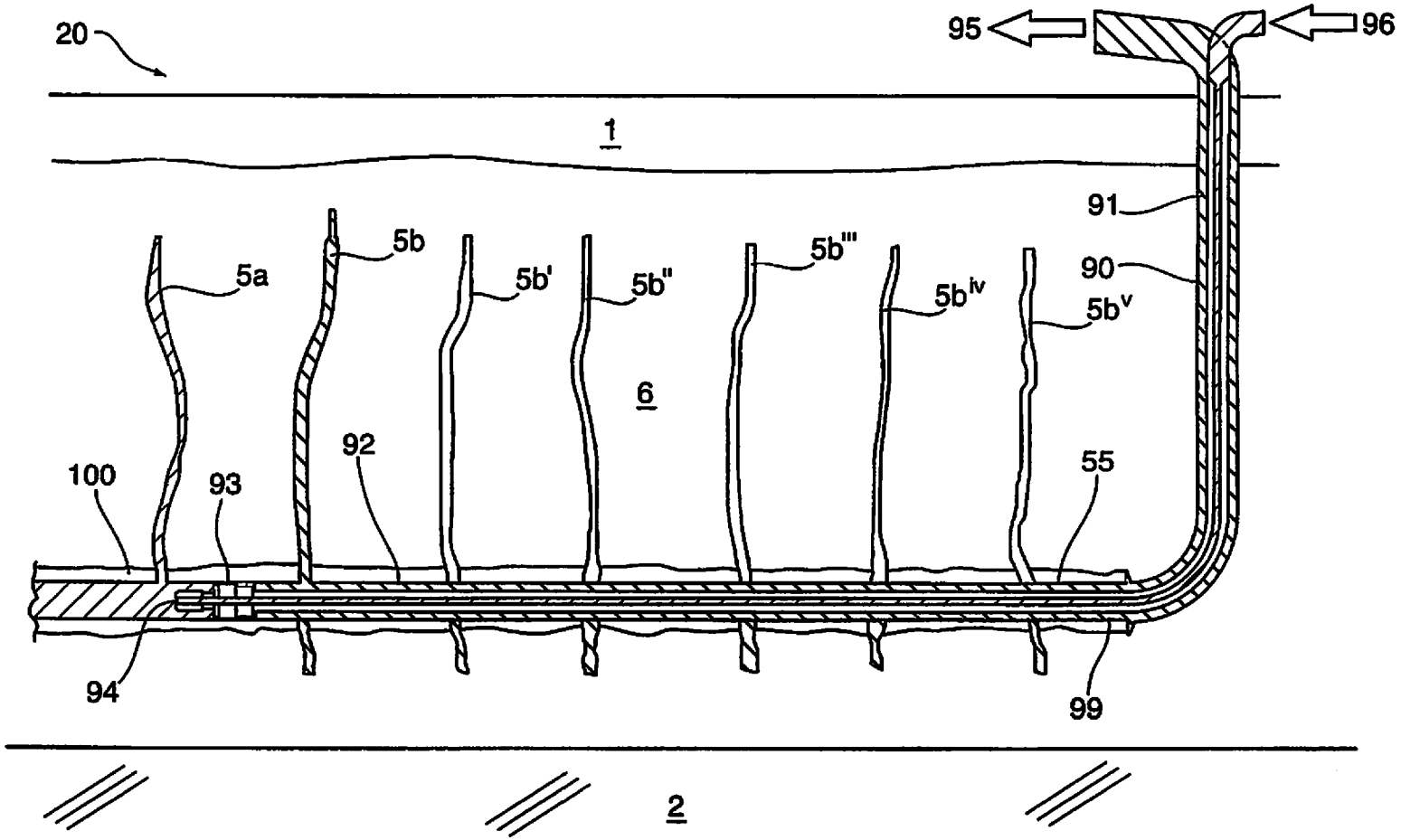
FIGS. 4A-4C show another embodiment of the process of the present invention, commencing with injection of fluid via the fracture at the distal end of the horizontal wellbore and producing from the adjacent fracture and, to a lesser extent , other fractures more proximate the proximal end of the horizontal wellbore(FIG. 4A), and subsequently moving a plug member toward a proximal (heel) end of the wellbore thereby converting fractures used for production into injection wells (FIGS. 4B, 4C)
Figure 4B:
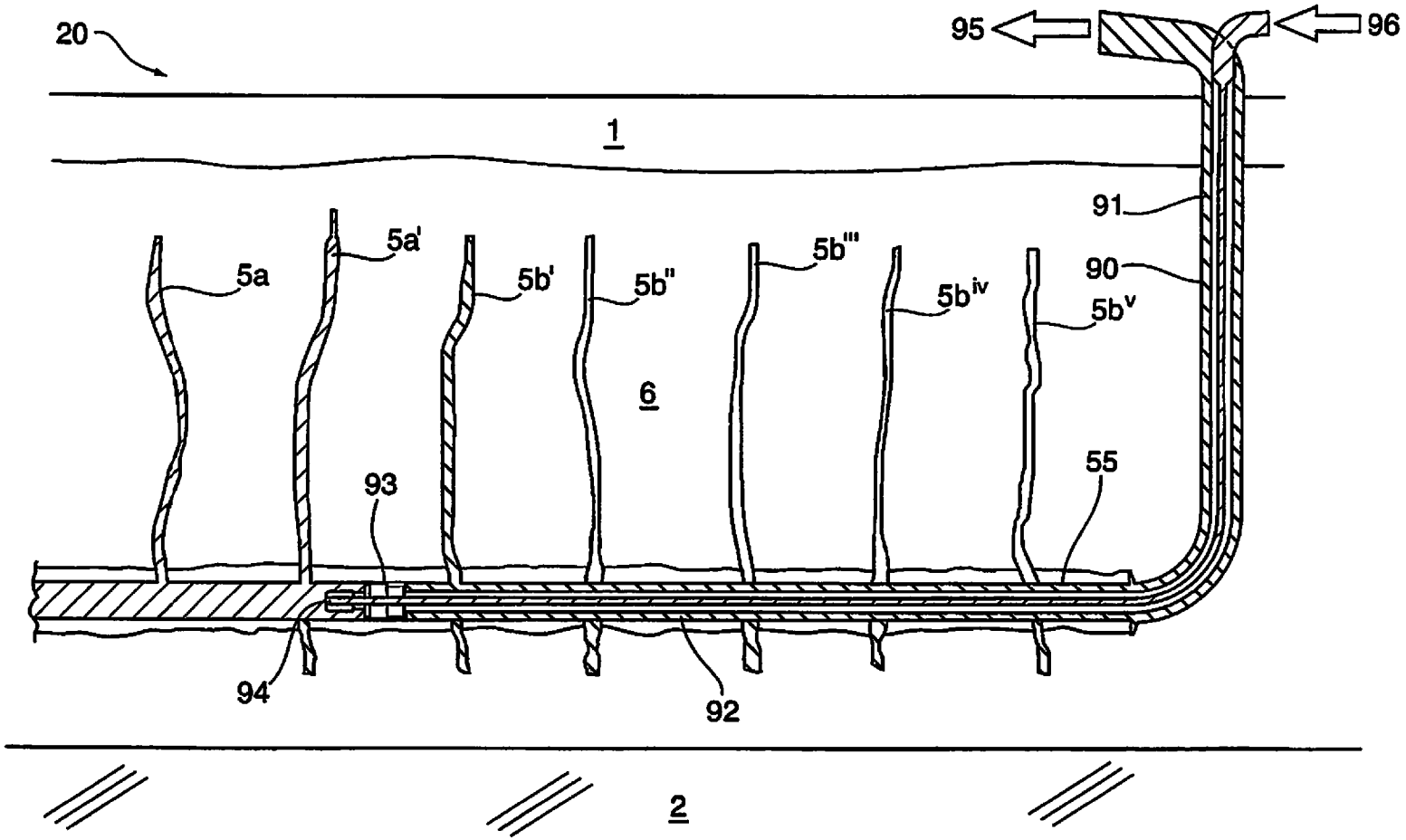
Figure 4C:
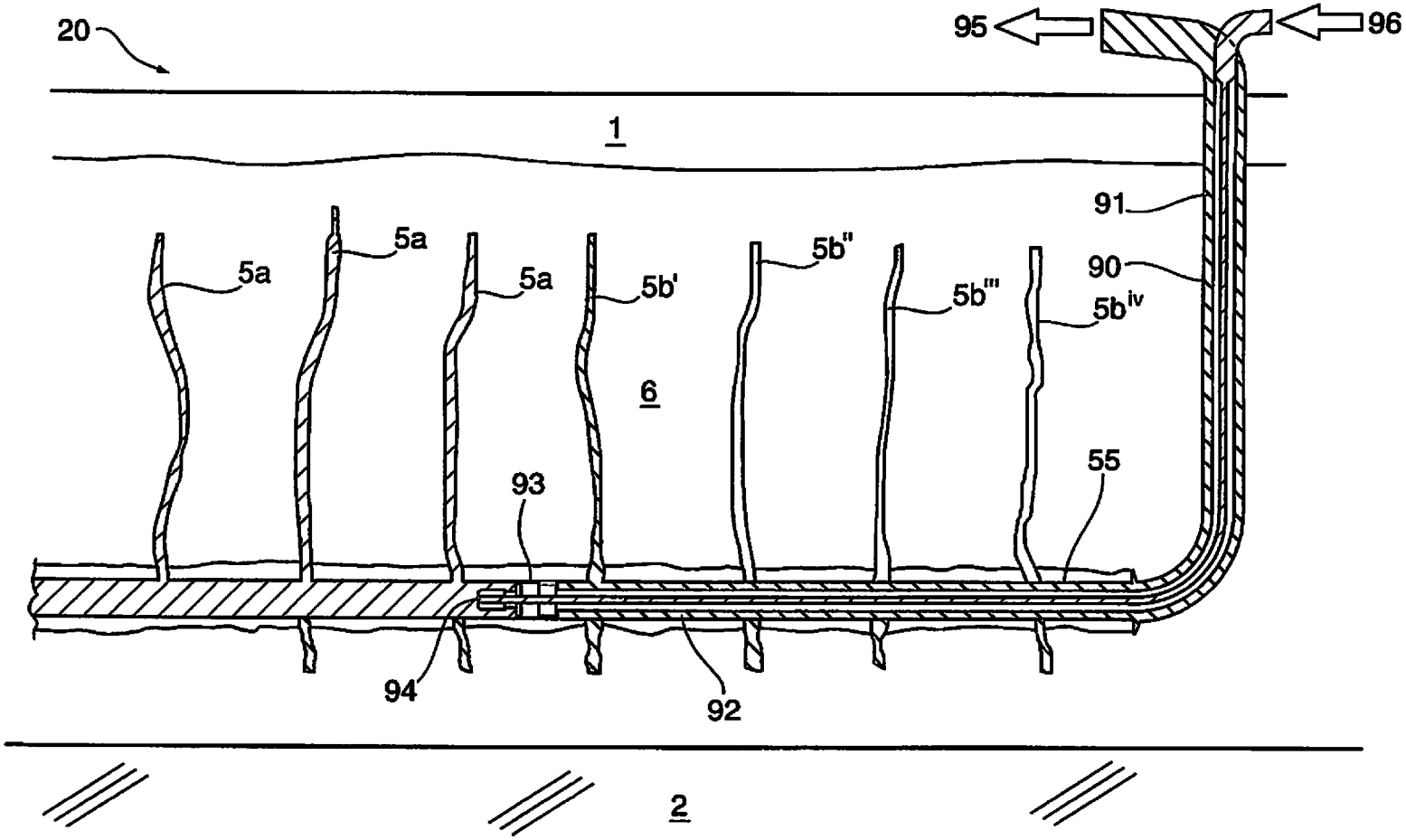

In the second variation of the method of the present invention, a first embodiment thereof being shown in FIGS. 4A-4C, only a single injection/production well 90 is drilled, having a vertical portion 91, and a horizontal portion 92 extending outwardly from a lower end of the vertical portion 91. A heel portion 99 is present at the base of the vertical portion 91, namely at the most proximal end of the horizontal portion 92, and a toe portion 100 is present at the opposite, most distal end of the horizontal portion 92.

Upwardly-extending fissures, shown as 5*a*, and 5*b*, 5*b*', 5*b*", 5*b* '", 5*b*$^{iv}$ and 5$^{v}$ in FIG. 4A, are created along the length of horizontal portion 92 by injecting a pressurized fluid at a plurality of discrete spaced locations along a length of said horizontal portion 92. The pressurized fluid contains a proppant, or alternatively a proppant is thereafter injected under pressure into said created such fissures and to render said fissures in a propped condition. Thereafter, injection tubing 55 is placed in horizontal portion 92 of well 90. Injection tubing 55 as an actuatable packer member 93, such as shown in FIG. 6, situated proximate a distal end of said tubing 55. Actuatable packer 93 is adapted, when hydraulically actuated via pressure in tubing 55, to create a seal between said tubing 55 and said horizontal portion 92.

In one embodiment of the process shown successively in FIGS. 4A-4C, packer 93 and injection tubing 55 is initially situated on a heel side of a most distal upwardly-extending fissure 5*a* as shown in FIG. 4A. Pressurized fluid 96 is injected into said injection tubing 55 so as to cause said fluid to flow into said most distal upwardly-extending fracture 5*a*, and producing oil to surface which flows into an annular area in said wellbore via a penultimate fissure Sb adjacent said most distal upwardly-extending fissure 5*a*.

Thereafter, packer member 93 is deactivated, and tubing 55 and packer member 93 are moved toward the heel 99, as shown in FIG. 4B. Packer member 93 is re-actuated so as to create a seal between injection tubing 55 and wellbore 90. Injection of said fluid 96 is re-commenced so as to inject said fluid 96 into said penultimate upwardly-extending fissure 5*a*', and producing oil which flows into said annular area via a fissure 5' adjacent said penultimate fissure 5*a*' on a heel side of said penultimate fissure 5.

Such process is further repeated, as shown in FIG. 4C, and thereafter, each time progressively converting successive production fissures 5*b*", 5*b*'", 5$^{iv}$ and 5$^{v}$ to respective production fissures 5*a*', 5*a*", etc. until reaching the heel portion 99 of horizontal portion 92, when hydrocarbons in such formation 6 will have then been substantially recovered.

Of course, the reverse of such process may also be conducted, to achieve substantially the same result, progressively driving and recovering from formation 6, from a heel 99 to toe 100, and in effect reversing the sequence, as shown progressively in FIGS. 4C-4A.

In such embodiment, the fissures 5*a* and 5*b*, 5*b*', 5", 5'", 5*b*$^{iv}$ and 5$^{v}$ are created as before, with fissure 5*a* being the fissure most proximate the heel portion 99 (ie situated at the proximal end of horizontal portion 92), and fissures 5*b*, 5*b*', 5*b*", 5*b*'", 5*b*$^{iv}$ and 5$^{v}$ extending respectively toward the toe 100. In such embodiment, when injection tubing 55 is positioned, aloing with actuable packer 93 in horizontal portion 92, such is positioned on a toe side of most proximal upwardly-extending fissure 5*a*. Packer 93 is actuated[3], and pressurized fluid 96 is injected into tubing 55 and thereby caused flow into fissure 5*b*, and possibly in addition remaining fissures 5*b*', 5*b*", 5*b*'", 5$^{iv}$ and 5$^{v}$. Hydrocarbons which flows into an annular area in said wellbore intermediate tubing 55 and wellbore 90 via said most proximal fissure 5*a* are produced to surface. Thereafter, packer member 93 is deactuated, and moved with said injection tubing toward toe portion 100, where packer member 93 is re-actuated. Fluid 96 is again injected into remaining upwardly-extending fissures 5*b*", 5*b* '", 5*b*$^{iv}$ and 5$^{v}$, and hydrocarbons which flow into said annular area via said most proximal fissure 5*a* and into a further adjacent penultimate fissure 5*a*', are produced to surface. Such process is further repeated, and thereafter, each time progressively converting successive production fissures 5*b*", 5*b*'", 5*b*$^{iv}$ and 5$^{v}$ to respective production fissures 5*a*', 5*a*", etc. until reaching the toe portion 100 of horizontal portion 92, when hydrocarbons in such formation 6 will have then been substantially recovered.

Figure 5A:
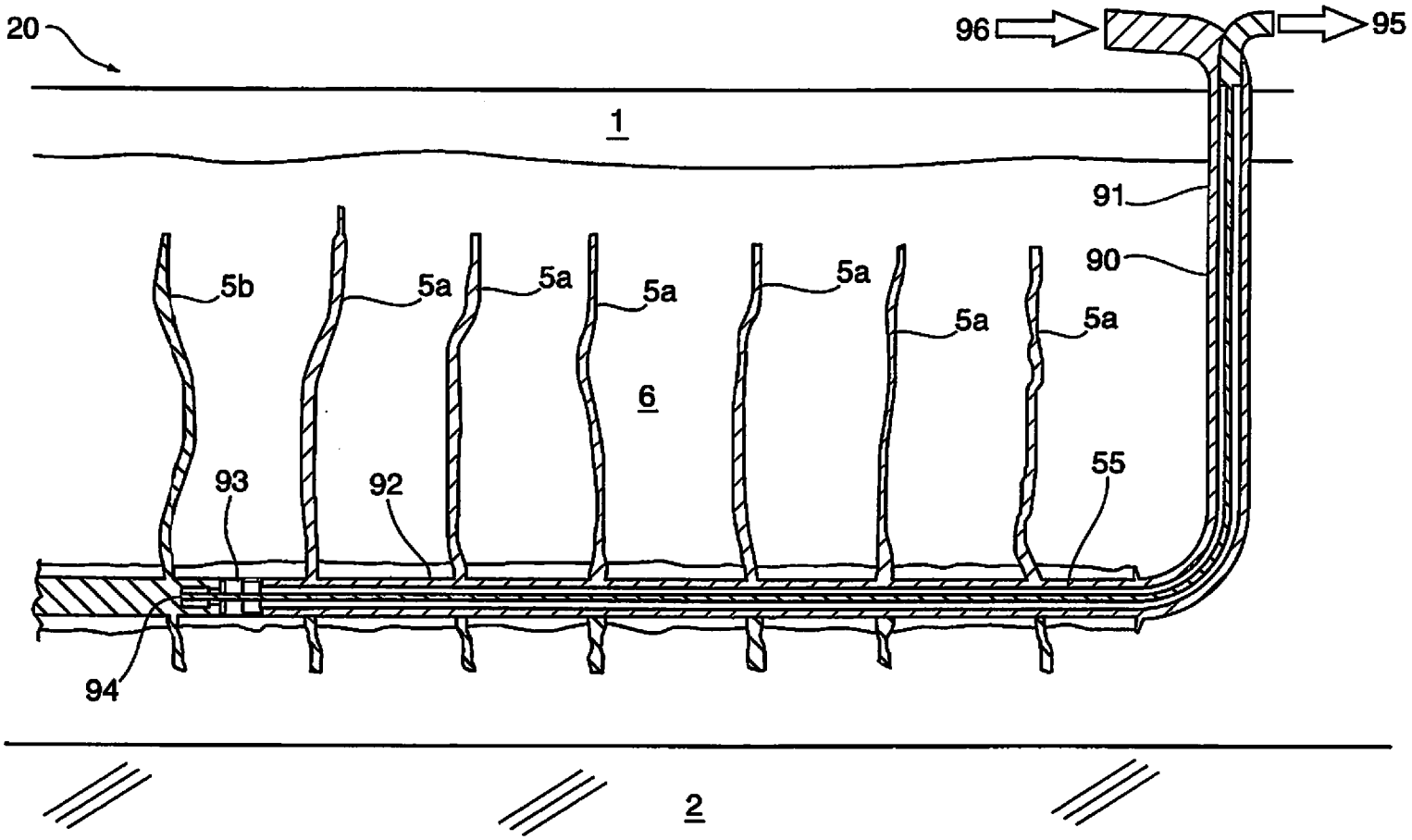
FIGS. 5A-5C show another embodiment of the process of the present invention similar to the embodiment shown in FIGS. 4A-4C commencing with injection of fluid via the penultimate distal fracture along the horizontal wellbore and producing from the most distal fracture, and subsequently moving a plug member toward the proximal (heel) end of the wellbore and subsequently thereby converting injection fractures into producing fractures (FIGS. 5B, 5C)
Figure 5B:
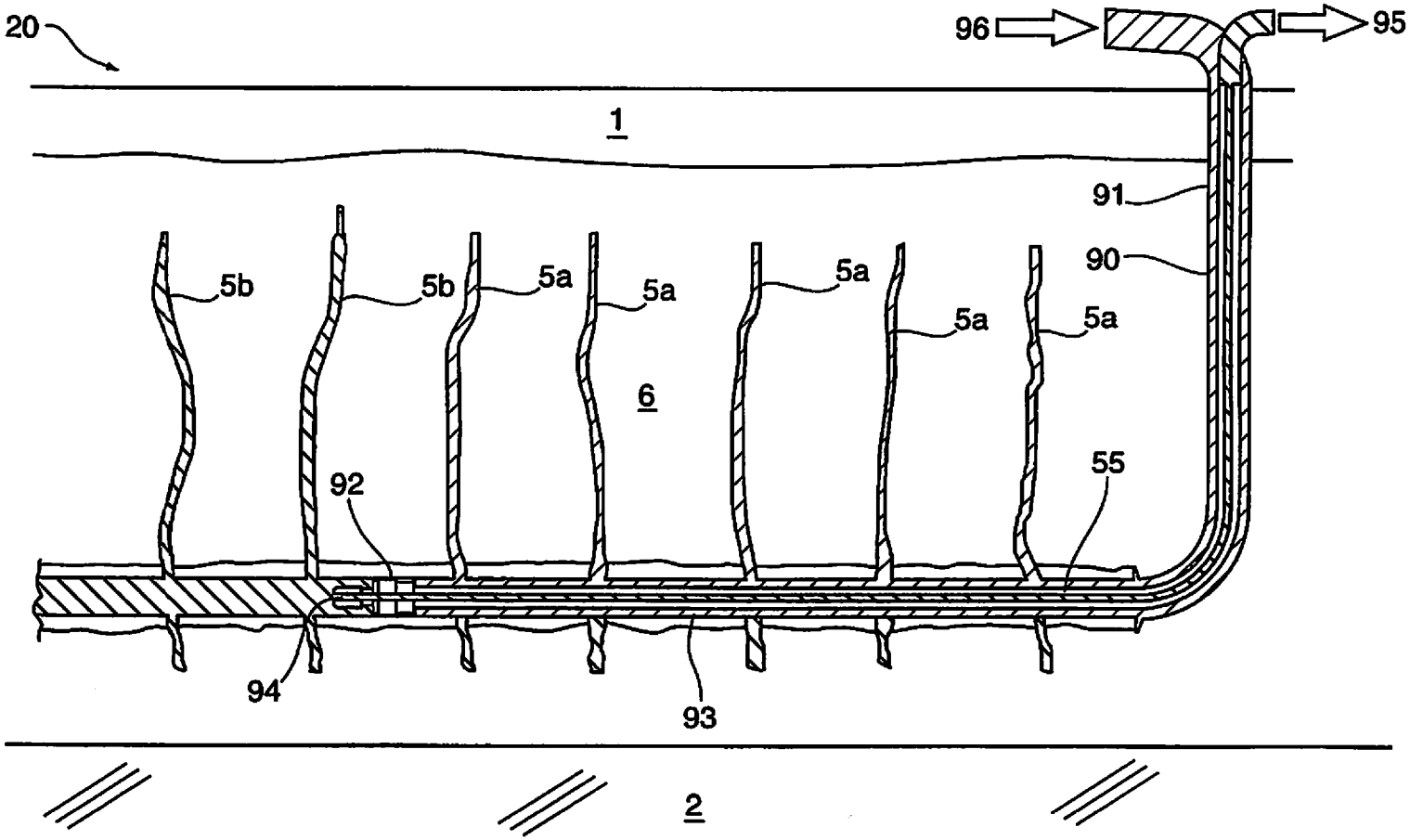

[3]In this embodiment packer 93 is not actuated by pressure within tubing 55 but rather actuated via other means well known to persons of skill in the art, such as by ball-drop methods, which are not needed to be discussed herein In a second embodiment of the second variation of the process of the present invention shown in FIGS. 5A-5C, again only a single injection/production well 90 is drilled, and upwardly extending fissures 5*a* and 5*b* are created along the length of horizontal portion 92, as shown in FIG. 5A, as per the manner described above. Production tubing 55 having an open end 94 and an actuatable packer 93 thereon is situated in horizontal portion 92, with packer member 93 situated proximate a toe portion 100, on a heel side of a most distal upwardly-extending fissure 5*b*, as shown in FIG. 5A. Packer member 93 is actuated to create a seal between tubing 55 and wellbore 90, and fluid 96 is injected into an annular area intermediate said production tubing 55 and said wellbore 90 and thereby into a penultimate fissure 5*a* adjacent said most distal upwardly-extending fissure 5*b*, as shown in FIG. 5A. Hydrocarbons 95 which drain into said horizontal portion 92 via said most distal upwardly-extending fissure 5*b* and which thereafter flow into said production tubing via said opening 94 therein, are produced to surface. After production slows, packer member 93 is de-actuated, and moved along with production tubing 55 towards heel portion 99, where is re-actuated. Injection of fluid 96 is re-commenced, as shown in FIG. 5B, so that fluid is again injected into said annular area so as to now be injected into an upwardly-extending adjacent fissure 5*a* on a heel side of a penultimate fissure 5*b*', and producing oil which flows into said production tubing via said penultimate fissure.

Figure 5C:
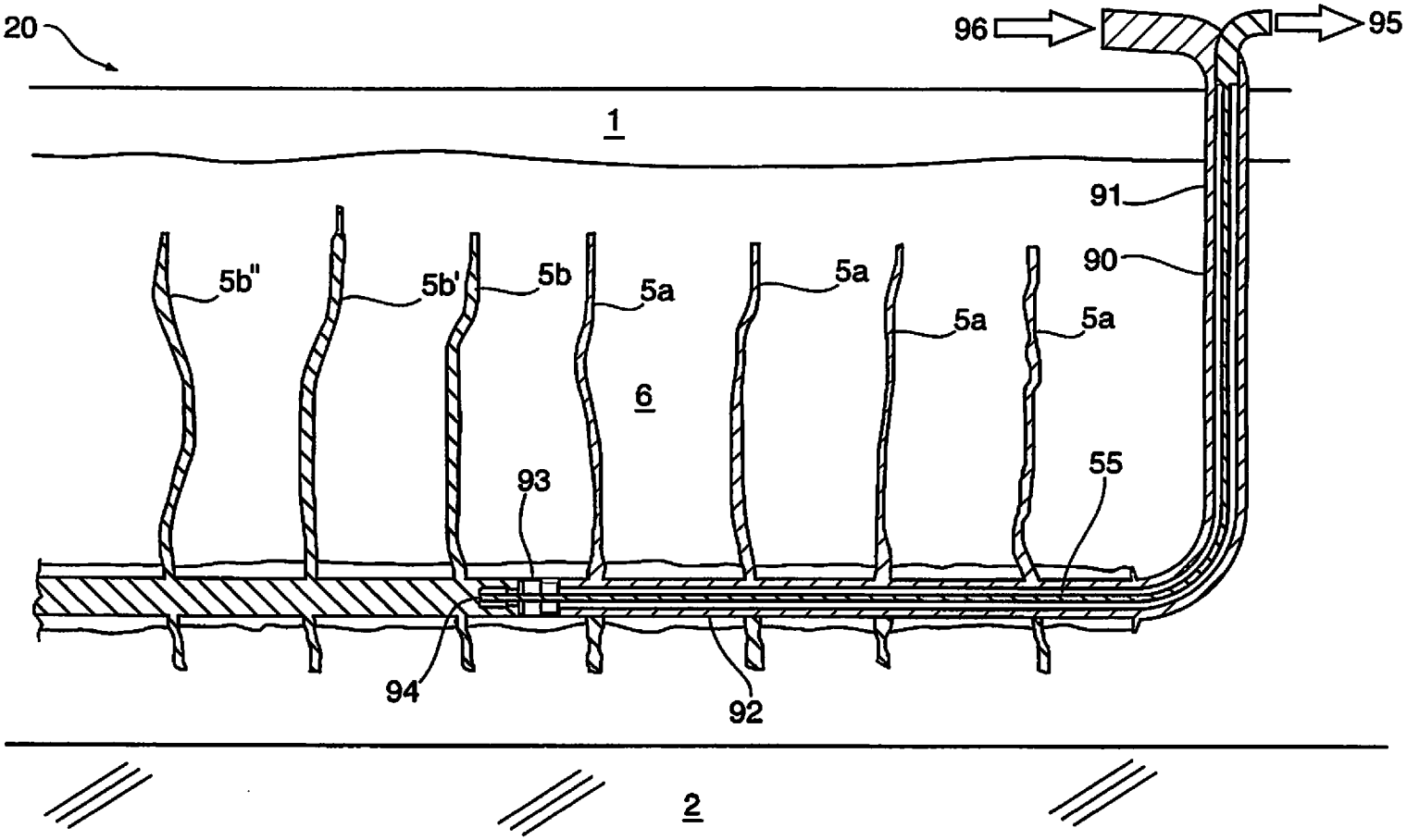

The above process is further repeated, as shown in FIG. 5C, and thereafter, successively converting injection fissures to production fissures, always progressing in the direction of the heel 99 of horizontal portion 92, until the entirety of formation 6 has been exposed to such process, and hydrocarbons recovered using such "drive" process.

Again, of course, the reverse of such process may similarly also be conducted , to achieve substantially the same result, progressively driving and recovering from formation 6, from a heel 99 to toe 100, and in effect reversing the sequence, as shown progressively in FIGS. 5C-5A.

In such embodiment, the fissures 5*a* and 5*b*, 5*b*', 5*b*", , 5*b*'", 5*b*$^{iv}$ and 5$^{v}$ are created as before, with fissure 5*a* being the fissure most proximate the heel portion 99 (ie situated at the proximal end of horizontal portion 92), and fissures 5*b*, 5*b*', 5*b*", 5*b*'", 5*b*$^{iv}$ and 5$^{v}$ extending respectively toward the toe 100.

Production tubing 55, having actuable packer member 93 thereon and an opening 94 at a distal end thereof, is positioned in horizontal portion 92 proximate heel portion 99. Packer 93 is actuated[4] to create a seal between said tubing 55 and said wellbore 90, on a toe side of a most proximal upwardly-extending fissure 5*a*. Fluid 96 in into an annular area intermediate said production tubing 55 and said wellbore 90 and thereby injected into said most proximal fissure 5*a*, and producing hydrocarbons which drain into said wellbore via said remaining upwardly-extending fissure 5*b* and which thereafter flow into said production tubing 55 via said opening 94 therein. The process is successively repeated by de-actuating packer member 93 and moving said packer member 93 and production tubing 55 toward said toe portion 100, re-actuating said packer member 93 and re-instituting injection of said fluid 96 into said annular area so as to inject said fluid 96 into a penultimate upwardly-extending fissure on a heel side of said most proximal fissure 5*a*, and producing oil which flows into said production tubing via an adjacent remaining fissure.

[4]In this embodiment packer 93 is not actuated by pressure within tubing 55 but rather actuated via other means well known to persons of skill in the art, such as by ball-drop methods, which are not needed to be discussed herein.

The above process is further repeated, successively converting production fissures to injection fissures, always progressing in the direction of the toe 100 of horizontal portion 92, until the entirety of formation 6 has been exposed to such process, and hydrocarbons recovered using such "drive" process.

Figure 12:
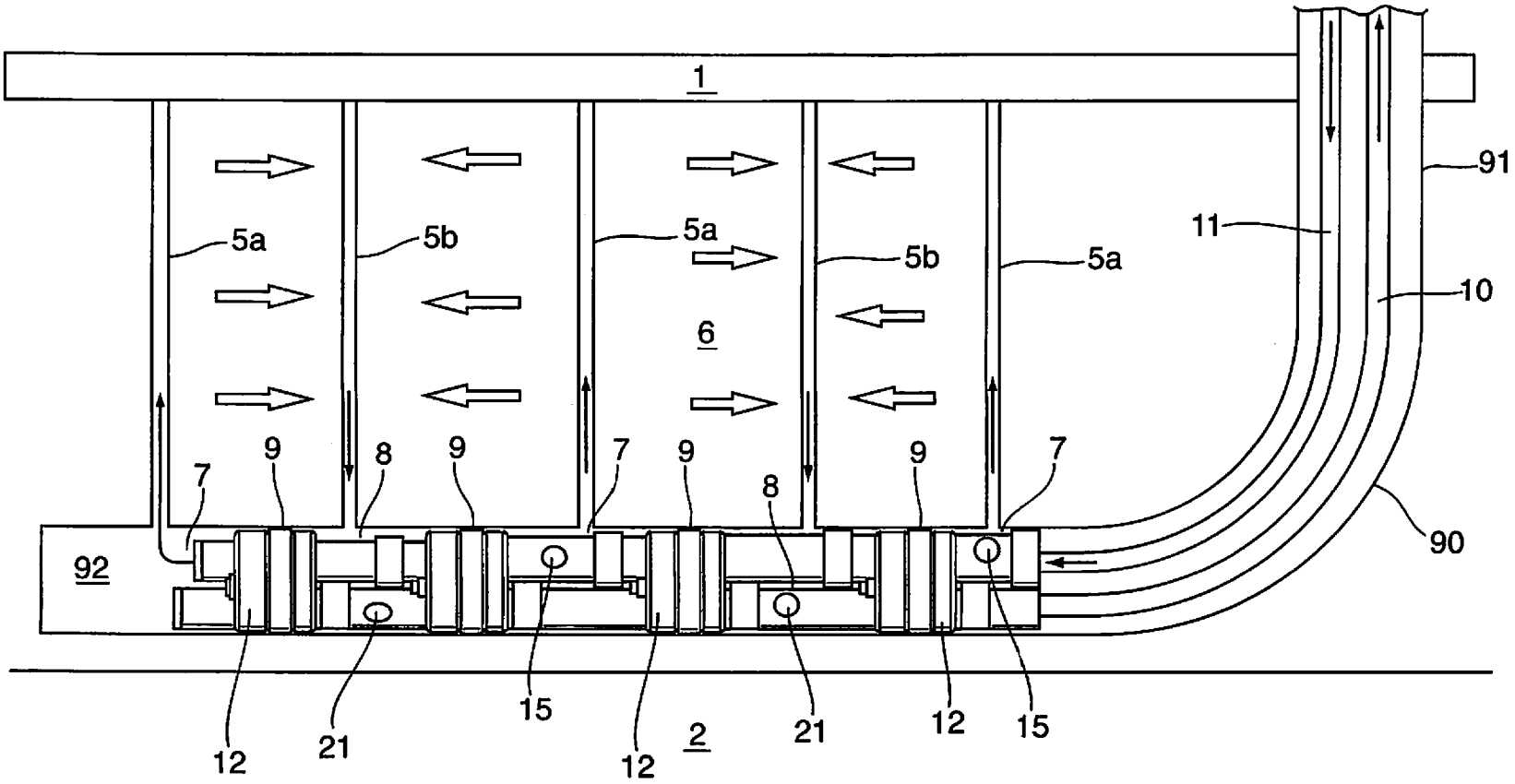
FIG. 12 is a schematic rendition of the method of the present invention using dual-tubing packers of the type described herein and shown in FIG. 11, and a single well for allowing fluid injection in alternately spaced vertical fissures and recovery of oil from alternately spaced fissures in the formation.

In another embodiment, the method of the present invention comprises using dual-tubing packers 12*a*, 12*b* and a single production/injection wellbore 90 to achieve fluid injection in alternately spaced vertical fissures 5*a* and further recovery of oil from alternately spaced recovery fissures 5*b* in the formation 6 , and such alternative method using dual-tubing packers 12*a*, 12*b* is shown schematically in FIG. 12.

Figure 11:
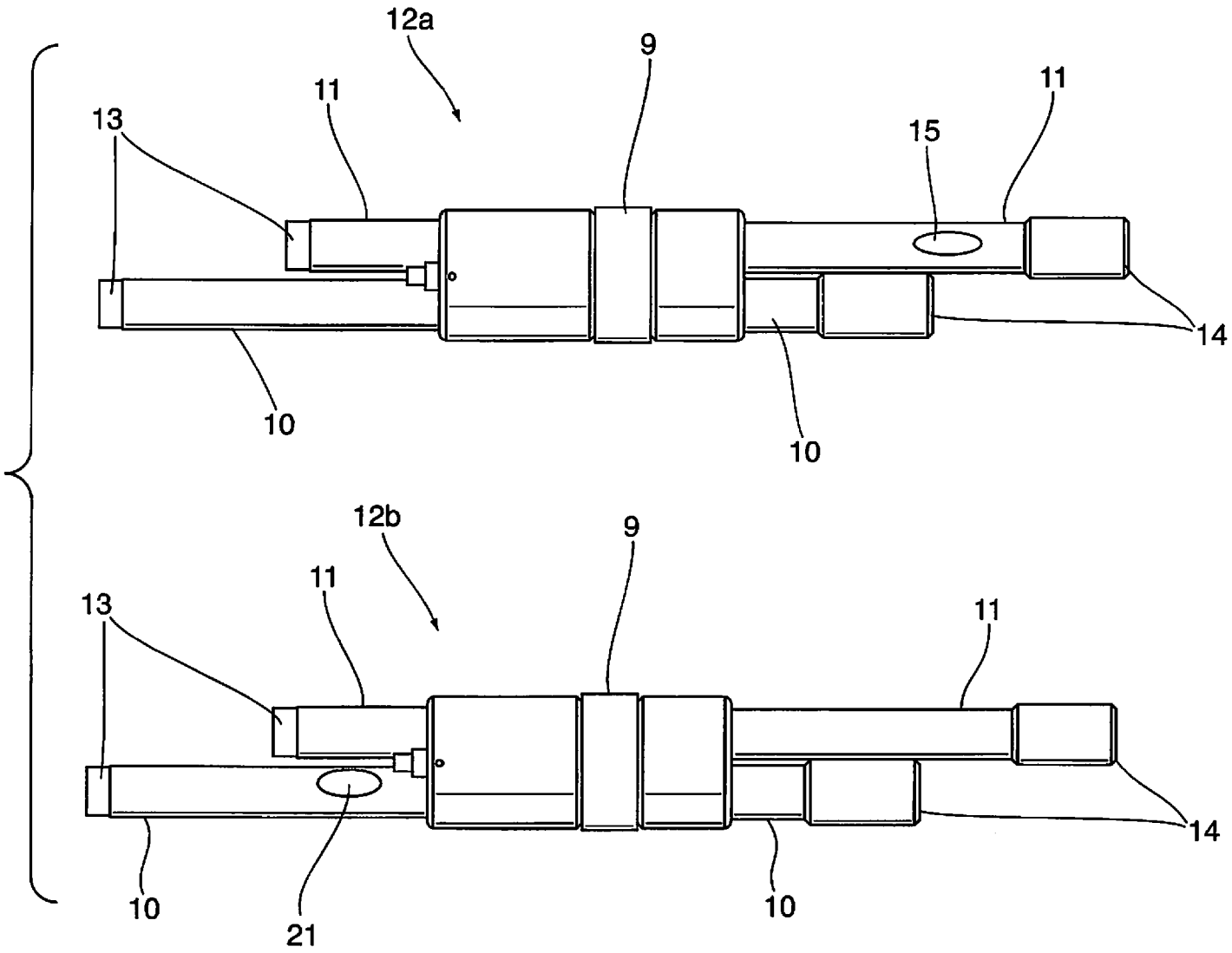
FIG. 11 is a depiction of, respectively, two versions of a dual-tubing packer, which can coupled together be used in the method of the present invention in a single well for allowing fluid injection in alternately spaced vertical fissures and recovery of oil from alternately spaced fissures in the formation.

An enlarged view of the dual-tubing packers 12*a*, 12*b* used in this particular method is shown in FIG. 11.

As may be seen from FIG. 12, the method of the present invention for recovering hydrocarbons from a subterranean formation 6 using fluid injection in alternating hydraulic fractures 5*a*, 5*b* created in formation 6, using dual-tubing packers 12*a*, 12*b*, comprises the steps of firstly drilling a single injection/production well 90 in formation 6, having a vertical portion 91 and a lower horizontal portion 92 extending horizontally outwardly from a lower end of said vertical portion 91.

Thereafter, in one embodiment of such method, a series of parallel upwardly-extending alternating fissures 5*a*, 5*b* respectively are created along the horizontal portion 92 of said injection/production well 90 by known fracking methods, such as inserting a series of packers 9, to thereby create spaced-apart sections 7,8 of horizontal portion 92 and allow supply of pressurized fracturing fluid to such isolated sections 7,8 so as to create vertical upwardly-extending alternating fissures 5*a*, 5*b* therefrom at spaced known distances along a length of horizontal portion 92 of injection/production wellbore 90.

Thereafter, if dual tubing packers 12*a*, 12*b* were used, such may then be re-used, or alternativey if they were not used, a dual tubing string 10,11 having dual tubing packers 12*a*, 12*b* spaced therealong may be inserted in the horizontal wellbore 92 thereby placing a plurality of packers 12*a*, 12*b* each having dual tubing 10, 11 passing therethrough and coupled together by coupling male threads 13 on each of dual tubings 10, 11 passing through packer 12*a* coupled to and threadably inserted in couplings 14 on packer 12*b*, and placing same along said length of said horizontal portion 92 of said injection/production well 90 and alternatingly spacing said packers 12*a*, 12*b* between said upwardly-extending fissures 5*a*, 5*b* along said length as shown in FIG. 12 thereby partitioning said length into alternatingly-spaced fluid injection regions 7 and fluid recovery regions 8. One tubing 11 of dual-tubing packers 12*a*, 12*b* has perforations 15 therein opposite alternatingly-spaced fissures 5*a* in injection regions 7, and the other of said dual tubing 10 having perforations 21 therein opposite remaining alternatingly-spaced fissures 5*b* in recovery regions 8.

A pressurized fluid is then injected into one of said dual tubing, namely injection tubing 10 and thereby, via apertures 15 therein injected into said fluid injection regions 7 and thus into alternatingly-spaced fissures 5*a* along said length of said horizontal portion of said injection/production well. Simultaneously, or subsequently, hydrocarbons which drain into said alternatingly-spaced fluid recovery regions 8 via other alternatingly-spaced fissures 5*b* and thereby into said other of said dual tubing 10 via apertures 21 therein are pumped/produced to surface.

Figure 13:
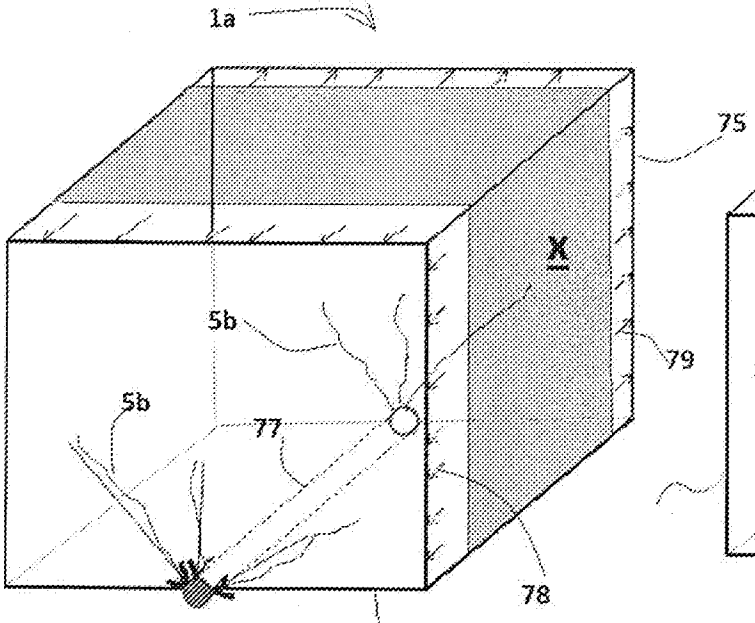
FIG. 13 is an enlarged schematic rendition of a formation, using only primary oil recovery, whereby collection is from all fissures/fractures.

FIG. 13 shows a prior (unsatisfactory) oil recovery method (not the subject of the present invention), wherein all fissures Sb are used for production. Specifically, FIG. 13 is an enlarged schematic representation of a portion of a formation 1 between two series of fractures 5*b* created along the length of the production wellbore 77 , using only primary oil recovery, whereby collection is from all fissures/fractures 5*b*. In such method, two(2) low-pressure permeability production planes 75 are provided, wherein heated oil may drain downwardly into production wellbore 77 for production to surface. Due to the lack of fluid drive, and in particular a fluid drive between adjacent alternatingly spaced fractures 5*b*, only small fluid flow vectors 78, 79 are created for oil flowing into production fractures 5*b*. Disadvantageously, in "tight" formations a significant portion la of the formation 1, namely the volume encircled by grey band "X", continues to possess trapped (unrecovered) bitumen which remains unrecovered by such process.

Figure 14:
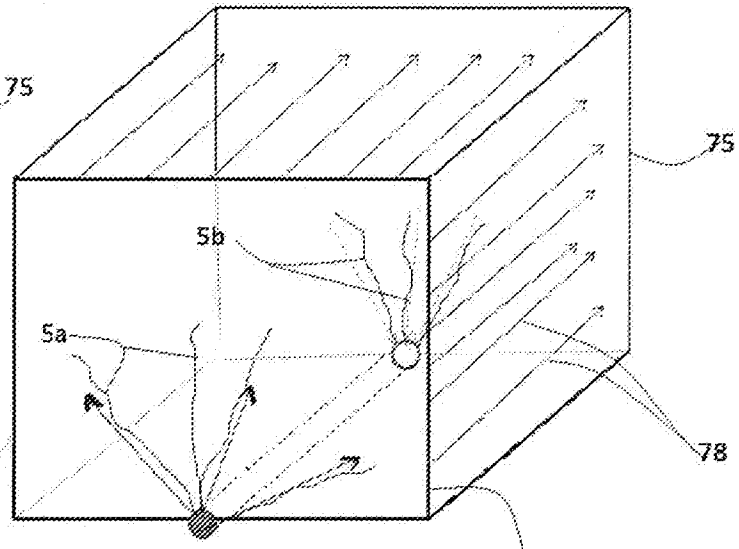
FIG. 14 is a similar enlarged schematic rendition of section of a formation intermediate two alternatingly spaced fractures in accordance with one method of the present invention, wherein the first series of fractures is used as a high pressure injection plane so as to produce high pressure in the region of injection fractures, and the most proximate alternatingly spaced fractures are used as a low pressure and high permeability production plane.

In comparison, FIG. 14 depicts a similar enlarged schematic representation of a portion 1*a* of a formation 1, using a method of oil recovery of the present invention.

Specifically, FIG. 14 depicts a method where alternatingly-spaced injection fractures Sa and production fractures 5*b* are positioned along a length of a production wellbore 77. An injection plane 76, created from fluid such as diluents, heated steam, $CO_2$, or viscosity-reducing agents, is injected into injection fractures 5*a*. Such fluid drives bitumen within the portion 1*a* of formation 1 in the single direction of fluid flow vectors 78 namely towards production fissures 5*b*, which thereby forms a high permeability (low pressure) production plane 75 within reservoir 1*a*, which allows bitumen to drain down into production wellbore 77 for production to surface. Advantageously, for "tight" formations , using such method of FIG. 14, and in contradistinction to the method of FIG. 13, bitumen is driven (swept) from substantially the entire volume of portion 1*a* of formation 1, and in particular from a larger volume of formation 1 than the volume of the formation that is drained in FIG. 13, thus increasing efficiency of production from a given volume of formation 1 as compared to the method depicted in FIG. 13.

EXAMPLES

In order to demonstrate the efficacy of the methods of the present invention over the prior art, at least with respect to the first variation using two separate wells in comparison to the prior art, four (4) cases of numerical simulations were conducted using the Computer Modelling Group's STARS reservoir modeling software starting with a standard CMG model as modified, with the parameters of Table 1 below:

TABLE 1

Numerical simulation parameters

| Reservoir | Value | Units |
|---|---|---|
| Temperature | 73 | Degree Celsius |
| pressure | 17,000 | kPa |
| Maximum safe injection pressure | 23,000 | kPa |
| Horizontal permeability | 0.50 | mD |
| Vertical permeability | 0.05 | mD |
| Oil saturation | 50 | % |
| Water saturation | 50 | % |
| Fracture permeability | 2000 | mD |

TABLE 1-continued

| Numerical simulation parameters | | |
|---|---|---|
| Reservoir | Value | Units |
| Oil density | 45 | Degree API |
| Gas-oil-ratio | 64 | Dissolved in oil |
| Model Parameters | | |
| Grid block size, I, j, k | 1, 5, 1 | meters |
| Number Grid blocks, I, j, k (¼ element of symmetry) | 200, 10, 40 | number |
| Full model volume | 1.6E06 | Cubic meters |
| Bottom-hole pressure | 100 | kPa |

A generic "tight" reservoir light oil was assumed, and the model employed an element of symmetry representing ¼ of the affected reservoir.

Test Results

Figure 9:
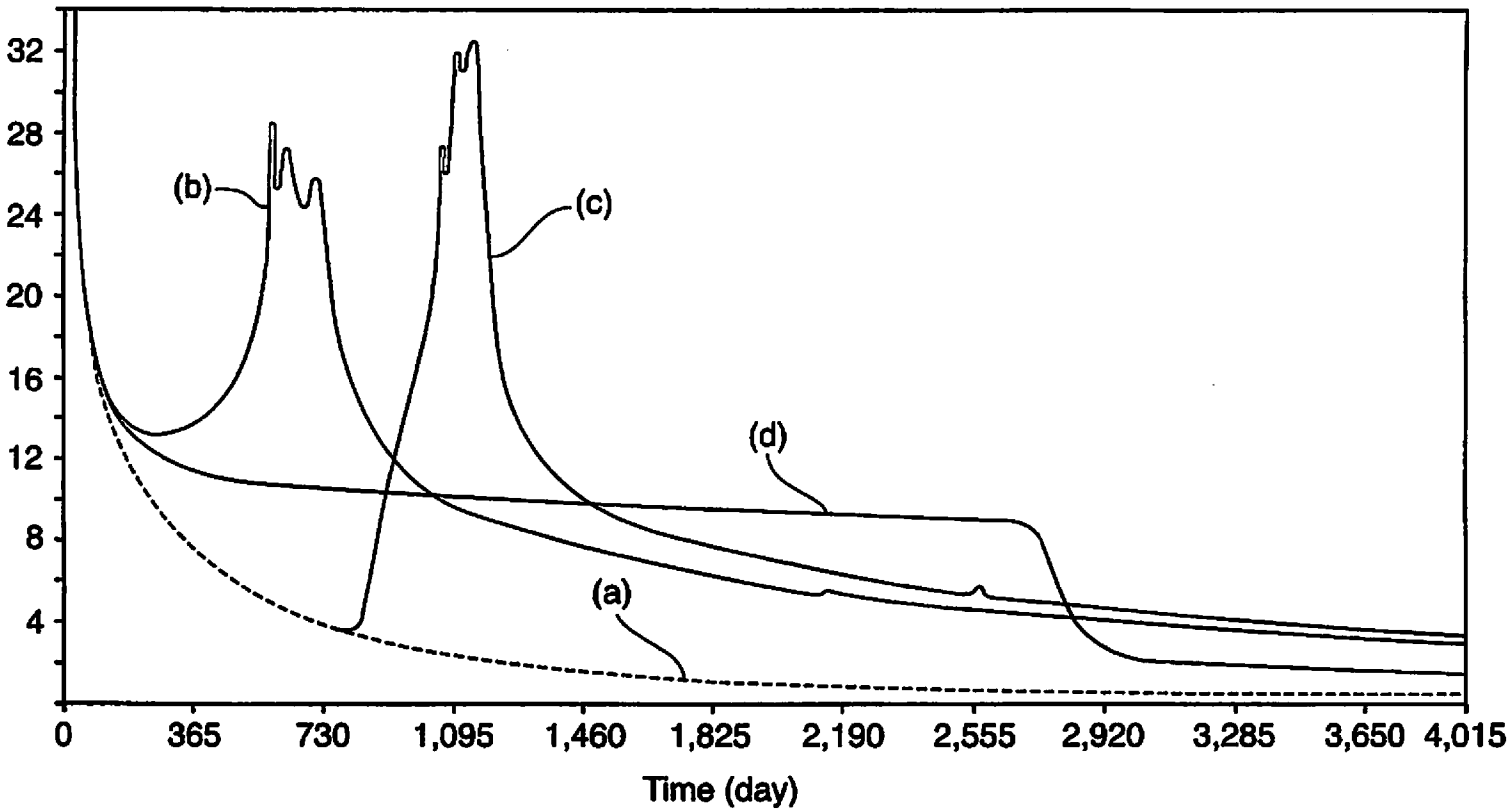
FIG. 9 is a graph showing oil production rate in m3/day (y axis) vs. time (days) (x axis) for various configurations allowing comparison of the method of the present invention shown in FIGS. 1-3 compared with the prior art method of producing from all fissures, wherein curve (a) is production without injection of driving fluid, curve (b) is the oil rate using gas fluid drive (methane), curve (c) is the oil rate with 2-years of primary oil production followed by gas injection (methane), and curve (d) is the oil rate where water is used as the injection fluid into alternately spaced fissures.
Figure 10:
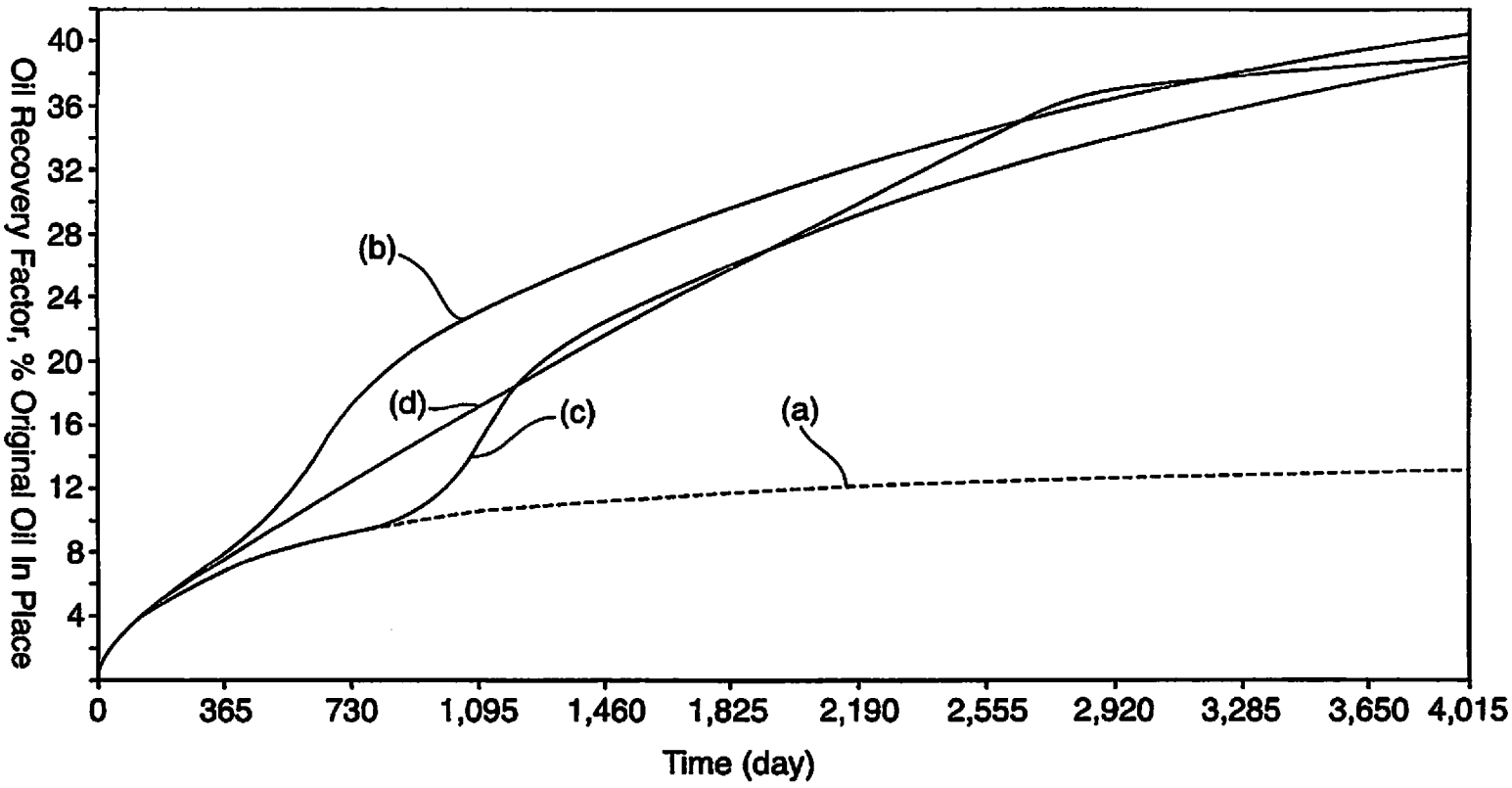
FIG. 10 is a graph showing oil recovery factor (y axis) as a percentage of original oil in place (% OOIP) vs. time (days) (x axis) for various configurations allowing comparison of the method of the present invention shown in FIGS. 1-3 compared with the prior art method of producing from all fissures, where line (i) is the % OOIP using primary production methods (ie from the injection and production wells), line (ii) is the % OOIP using gas drive fluid injection in the injection well , line (iii) is the % OOIP with 2-years of primary oil production followed by gas injection, and line (iv) is the % OOIP using water injection.

FIGS. 9 & 10 show the oil production rates and Oil Recovery Factors, respectively, over time, for various embodiments of the present invention compared with the prior art "primary" recovery method using production from all created fissures.

As regards FIG. 9, FIG. 9 shows the oil production rate for various configurations as follows:

curve (a)—depicts oil production rate for the primary production method using production from each of the two wells drilled (i.e. from all of the fissures created in the formation) over time, over the period of 11 years (i.e. 4015 days);

curve (b)—depicts oil production rate for the second embodiment of the present invention as a function of time (days), namely primary production from all of the fissures created for a period of 2 years, followed by gas injection into every other fissure and production from the remaining fissures, over the remaining 9 years;

curve (c)—depicts oil production rate for the first embodiment of the present invention as a function of time (days), namely gas injection into every other fissure and production from the remaining fissures, over the period of 11 years; and curve (d)—depicts oil production rate for the second embodiment of the present invention as a function of time (days), namely primary production from all of the fissures created for a period of 2 years, followed by water injection into every other fissure and production from the remaining fissures, over the remaining 9 years.

As regards FIG. 10:

curve (a)—depicts oil % OOIP for the primary production method using production from each of the two wells drilled (ie from all of the fissures created in the formation) over time, over the period of 11 years (ie 4015 days);

curve (b)—depicts % OOIP for the second embodiment of the present invention as a function of time (days), namely primary production from all of the fissures created for a period of 2 years, followed by gas injection into every other fissure and production from the remaining fissures, over the remaining 9 years;

curve (c)—depicts % OOIP for the first embodiment of the present invention as a function of time (days), namely gas injection into every other fissure and production from the remaining fissures, over the period of 11 years; and curve (d)—depicts oil production rate for the second embodiment of the present invention as a function of time (days), namely production from ½ the fissures, with remaining alternating fissures being injected with water.

As may be seen from FIG. 9, the production rate of primary oil production [curve (a)] falls off very quickly. After 3-years the production rate [curve (a)] is only 2 m3/d with a Recovery Factor (from FIG. 9) of 10.5%, which is an un-economical level. The 10-year Recovery Factor (see FIG. 9) is only 13.3%.

However, if gas is injected in the manner of the present invention, namely in alternately spaced fractures, after 2 years of primary oil production, while keeping the injection pressure below the maximum safe (non-fracturing) level of 23,000 kPa, as may be seen from curve (c) of FIG. 9, a surge of oil production occurs.

Table 2 below summarizes additional results from the above tests, including % OOIP obtained from FIG. 10 for arbitrary time periods of 3 years and 11 years, with respect to four(4) different configurations, (i) "Primary", meaning production from all fissures, without fluid injection in alternate fissures; (ii) "Gas", meaning production from ½ the fissures, with remaining alternating fissures being injected with gas; (iii) "Primary then Gas" meaning initial production from all fissures, followed by production from ½ the fissures, with remaining alternating fissures being injected with gas; and (iv) "water", meaning production from ½ the fissures, with remaining alternating fissures being injected with water.

TABLE 2

| | Primary* | Gas | Primary then gas** | water |
|---|---|---|---|---|
| 3-year recovery factor, % OOIP | 10.5 | 23.0 | 14.6 | 17.1 |
| 11-year recovery factor, % OOIP | 13.2 | 40.7 | 39.2 | 39.2 |
| Cumulative gas rate injected, S m3 | — | 60.3E06 | 48.8E06 | — |
| Cumulative water injected, m3 | — | — | — | 43,244 |

*Production from all fissures (Not part of this invention)

**Two-years of primary production followed by 9-years of gas Injection.

When gas is injected from the outset [Curve (b)], instead of after 2 years of primary oil production, the peak oil production rates occur approximately 480 days (ie 1.3 years) earlier, which is beneficial regarding the value of money [compare curve (b) and curve(c)]. Nevertheless, the delayed start to gas injection has only a modest effect on the Oil Recovery factor, since after eleven years, as seen from FIG. 10 and Table 2, the difference in oil recovery factor (% OOIP) is relatively minor, namely only 1.5% [i.e. 40.7% for curve (b) as compared with 39.2% for curve (c) ].

Figure 8:
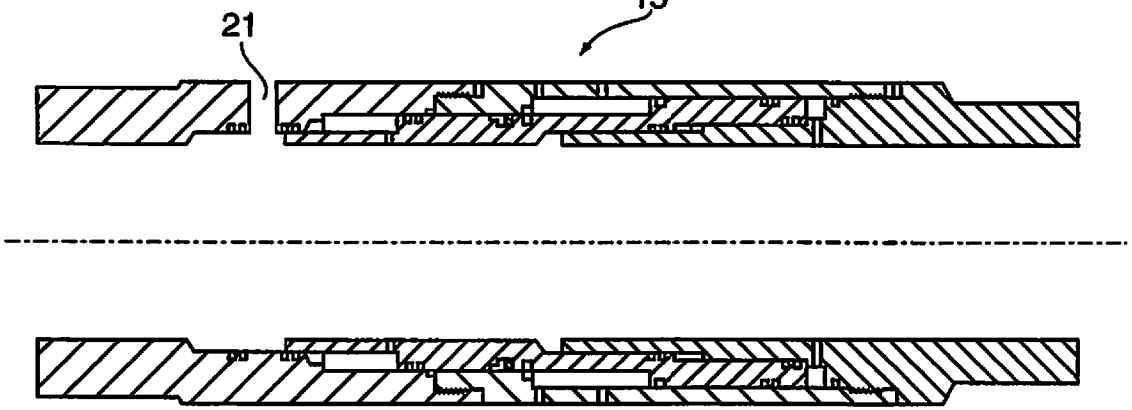
FIG. 8 is a similar sectional view of the pressure-actuated sliding sleeve of FIG. 7, wherein the sliding sleeve is shown in the position where the aperture is opened.

Significantly, as seen from FIG. 10 and Table 2 above, using the fluid drive oil recovery process of the present invention , in either the first embodiment using immediate gas injection in the injection well fissures and production from the production well fissures (namely curve (b) of FIG. 8), or the second embodiment utilizing initial production from all fissures for a period of two years subsequently followed by injection from the injection well and production from the production well [i.e. curve (c) of FIG. 8] after 11 years, each provide a high oil recovery factor of approximately 40%.

Conversely, again with reference to FIG. 10, with the prior art primary production method comprising production from each of the production well and injection well, namely from all fissures created along two wells (i.e. curve (a) of FIG. 10), after 11 years such method merely produces an oil recovery factor of 13.2%.

Accordingly, in the scenario modelled, use of the present invention has been able to increase the % OOIP recovery by an amount of approximately 26% (i.e. 39.2%-13.2%).

The above disclosure represents embodiments of the invention recited in the claims. In the preceding description, for purposes of explanation, numerous details are set forth in order to provide a thorough understanding of the embodiments of the invention. However, it will be apparent that these and other specific details are not required to be specified herein in order for a person of skill in the art to practice the invention The scope of the claims should not be limited by the preferred embodiments set forth in the foregoing examples, but should be given the broadest interpretation consistent with the description as a whole, and the claims are not to be limited to the preferred or exemplified embodiments of the invention.

The invention claimed is:

1. A process for recovering hydrocarbons from a subterranean formation via a single wellbore utilizing hydraulic fractures which become injection and production channels within said formation, comprising the steps of:

(i) drilling the wellbore for injection and production, the wellbore having a vertical leg and a horizontal leg, said horizontal leg extending horizontally outwardly from a lower end of said vertical leg and terminating at a distal end of said horizontal leg, said horizontal leg having a heel proximate a proximal end thereof, and a toe proximate the distal end thereof;

(ii) fracturing the formation and creating upwardly-extending fissures in the formation along said horizontal leg by injecting a pressurized fluid into said horizontal leg, at a plurality of discrete-spaced locations along a length of said horizontal leg;

(iii) wherein said pressurized fluid contains a proppant, or after step (ii) above injecting a proppant under pressure into said created fissures, to render said upwardly-extending fissures in said formation in a propped condition;

(iv) positioning an elongate hollow tubing into said horizontal leg and forming an annular area intermediate said tubing and said wellbore, said tubing having an opening at a distal end thereof and an actuatable packer member proximate said distal end of said tubing adapted when actuated to create a seal between said tubing and said wellbore, and situating said packer member and said tubing within said wellbore proximate said heel of said wellbore on a toe side of a most proximal upwardly-extending fissure;

(v) actuating said packer member to create a seal between said tubing and said wellbore;

(vi) injecting said pressurized fluid or another fluid into a first one of said annular area and said tubing via said opening therein, and thereby injecting said fluid into said most proximal upwardly-extending fissure, and producing hydrocarbons which drain into said wellbore via said remaining upwardly-extending fissures and which thereafter flow into a second one of said annular area and said tubing via said opening therein;

(vii) de-actuating said packer member, and moving said packer member and tubing in a direction toward said toe; and (viii) re-actuating said packer member and re-instituting injection of said fluid, and injecting said fluid into said annular area so as to inject said fluid into another adjacent upwardly-extending fissure on toe side of said most proximal fissure, and producing hydrocarbons which flows into said second one of said annular area and said tubing via remaining fissures.

2. The process as claimed in claim 1, wherein step (viii) comprises producing hydrocarbons which flows into said second one of said annular area and said tubing via remaining fissures on a toe side of said another adjacent upwardly-extending fissure.

3. The process as claimed in claim 1 further comprising a draining step of:

before actuating said packer member at step (v), receiving hydrocarbons from the formation from all of said upwardly-extending fissures.

4. The process as claimed in claim 3, wherein step (v) is performed after a period of time from said draining step.

5. The process as claimed in claim 3 further comprising:

monitoring production rate of hydrocarbons; and performing said draining step after said production rate has reduced to a low rate.

* * * * *